US005816817A

United States Patent [19]

Tsang et al.

[11] Patent Number: 5,816,817

[45] Date of Patent: Oct. 6, 1998

[54] MULTIPLE WEAPON FIREARMS TRAINING METHOD UTILIZING IMAGE SHAPE RECOGNITION

[75] Inventors: Wenlong Tsang, Duluth; Bobby Hsiang-Hua Chung; Christopher Alan Bailey, both of Atlanta, all of Ga.

[73] Assignee: FATS, Inc., Suwanee, Ga.

[21] Appl. No.: 427,110

[22] Filed: Apr. 21, 1995

[51] Int. Cl.[6] ..... F41G 3/26

[52] U.S. Cl. ..... 434/22; 434/21; 348/121; 463/5

[58] Field of Search ..... 434/11, 16, 27; 463/49, 55, 5, 50; 273/317.1; 348/61, 121; 353/10, 30

[56] References Cited

U.S. PATENT DOCUMENTS

| | | | |
|---|---|---|---|
| 4,223,454 | 9/1980 | Mohon et al. | 434/22 X |
| 4,336,018 | 6/1982 | Marshall et al. | 434/22 |
| 4,793,811 | 12/1988 | Eichweber . | |
| 4,898,391 | 2/1990 | Kelly et al. . | |
| 5,194,008 | 3/1993 | Mohan et al. . | |
| 5,213,503 | 5/1993 | Marshall et al. . | |

FOREIGN PATENT DOCUMENTS

| | | | |
|---|---|---|---|
| WO94/15165 | 7/1994 | WIPO | 434/22 |

OTHER PUBLICATIONS

Caswell Int'l Corp. — "Cinetronic–Interactive Firearms Training System"–belived to be known prior to Apr. 21, 1995.

Caswell Int'l Corp. — "Gamma–Live Fire Video Training System–Theres No Substitute for Live Fire Training"–believed to be known prior to Apr. 21, 1995.

Caswell Int'l Corp. — "Gamma–1 Live Fire Video Training System" believed to be known prior to Apr. 21, 1995.

*Primary Examiner*—Joe Cheng

*Attorney, Agent, or Firm*—Isaf, Vaughan & Kerr; Louis T. Isaf

[57] ABSTRACT

A method and apparatus for simultaneously training multiple trainees in the use of simulated weapons, which method defines a set of image shapes and assigns each image shape to a different simulated weapon capable of generating a light beam, at a selected wavelength, having the assigned image shape. By collecting data under control conditions and evaluating a set of parameters that uniquely identifies each image shape and by comparing the resulting "control parameters" to the same set of parameters evaluated under training conditions (thereby, producing "on-line parameters") each image shape produced during a training session is identified and associated with a simulated weapon. The method enables an expanded number of trainees to be simultaneously trained, by employing the same set of image shapes produced and detected at different wavelengths. In accordance with the preferred embodiment, the apparatus includes a plurality of simulated weapon having a light source, a reflective surface, a light data acquisition assembly, and a controller to analyze and compare collected data. The light data acquisition assembly comprises a rasterizing sensor (i.e., a CCD camera), wavelength filter, and a data acquisition interface has a plurality of counters which convert pixel intensity and location data into a category of data, including position, length and intensity, for each segment of an image shape for subseqent receipt by the controller.

26 Claims, 16 Drawing Sheets

54
34
40d
40c
40b
40a
38d
36d
38c
36c
38b
36b
38a
36a
41d
41c
41b
126
41a
46
42
32
44
48
116
30
128
52

42
90
116
500
AREA ARRAY IMAGE SENSOR
DATA ACQUISITION INTERFACE
MEDIA PLAYER
118
120
MEDIA PLAYER INTERFACE
122
PROJECTOR
54
126
VIDEO/GRAPHICS INTERFACE
124
50
96
CONTROLLER BUS
32
104
PRINTER INTERFACE
PRINTER (OPTIONAL)
102
CONTROLLER PROCESSOR
98
RAM
100
FLOPPY/HD CONTROLLER
108
FLOPPY DRIVE
106
HD
110
MONITOR INTERFACE
94
MONITOR (OPTIONAL)
92
POWER SUPPLY
112
TO AC SOURCE
KEYBOARD (OPTIONAL)
114

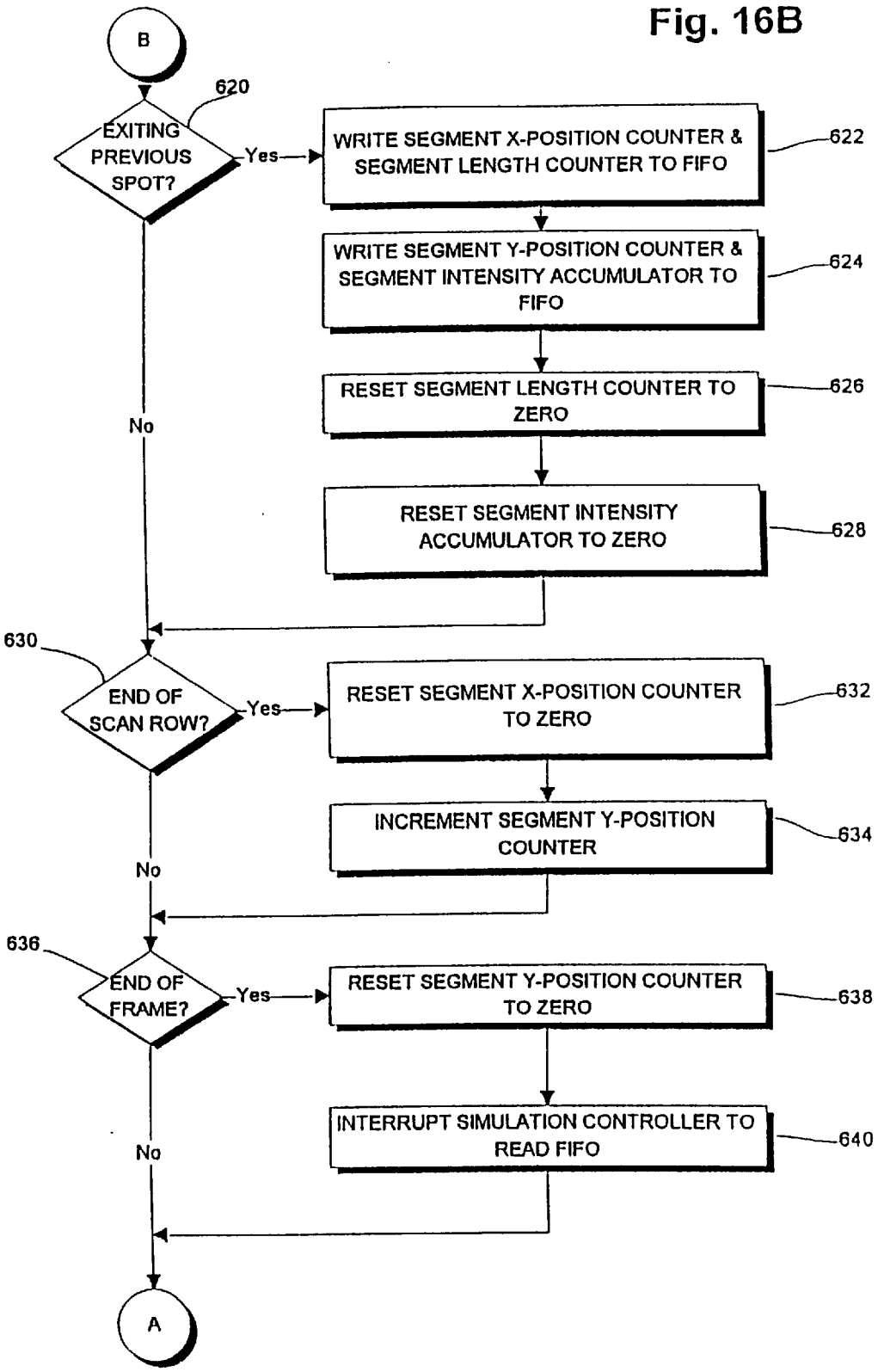
Fig. 16B
B
620
EXITING PREVIOUS SPOT?
Yes
No
WRITE SEGMENT X-POSITION COUNTER & SEGMENT LENGTH COUNTER TO FIFO
622
WRITE SEGMENT Y-POSITION COUNTER & SEGMENT INTENSITY ACCUMULATOR TO FIFO
624
RESET SEGMENT LENGTH COUNTER TO ZERO
626
RESET SEGMENT INTENSITY ACCUMULATOR TO ZERO
628
630
END OF SCAN ROW?
Yes
No
RESET SEGMENT X-POSITION COUNTER TO ZERO
632
INCREMENT SEGMENT Y-POSITION COUNTER
634
636
END OF FRAME?
Yes
No
RESET SEGMENT Y-POSITION COUNTER TO ZERO
638
INTERRUPT SIMULATION CONTROLLER TO READ FIFO
640
A

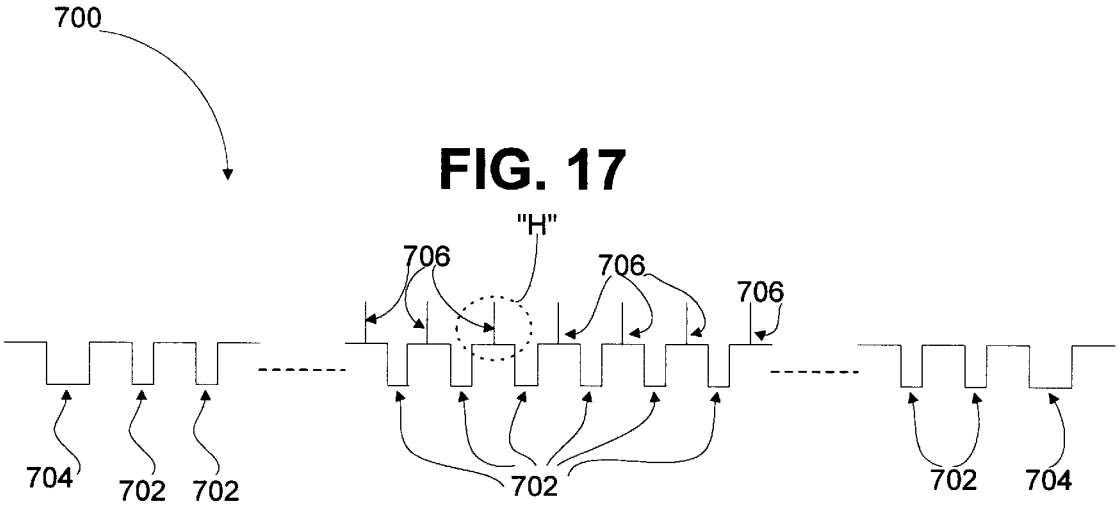
FIG. 17
FIG. 18
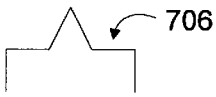

MULTIPLE WEAPON FIREARMS TRAINING METHOD UTILIZING IMAGE SHAPE RECOGNITION

FIELD OF THE INVENTION

This invention relates generally to the field of optical/electrical identification and discrimination of known image shapes, and in its preferred embodiment, to integrating an area array image sensor to enable identification of image sources in a multiple weapon firearms training system.

BACKGROUND OF THE INVENTION

The firearms training industry has, for a number of years, trained individuals in the use of firearms by using systems that incorporate simulated weapons and simulated scenarios. Typically, these systems present a trainee with simulated situations which require the trainee to exercise judgment in determining when and where to fire his/her simulated weapon. The simulated situations are, generally, produced as movie-type vignettes using live actors and actual locations to create as much realism as possible for the trainee. The vignettes are pre-recorded on video tape, digital video, or laser disk and are played back during the training exercise for projection onto a screen or other reflective surface. As the trainee watches the vignette unfold, the trainee must distinguish the "good guys" and innocent bystanders from the "bad guys" and, in choosing when to fire his/her simulated weapon, the trainee must also exercise judgment to avoid the risk of accidentally injuring a "good guy" or innocent bystander. For example, a typical vignette might include a scenario in which a prisoner overpowers a guard and takes the guard's gun while on a work detail. The prisoner then attempts to escape and, while fleeing, fires the gun at the trainee who is posing as another guard in the scenario. The trainee must distinguish the prisoner from the guard and must avoid firing his/her simulated weapon at the prisoner while the guard or others are positioned where they may be injured by a stray "shot". Throughout the vignettes, the systems, generally, detect and record the location of each "shot" fired by the trainee in relation to the position of the "bad guys". The systems may also detect and record the reaction time of the trainee by measuring the amount of time that transpires between the presentation of a "bad guy" as a threat and the firing of the simulated weapon by the trainee.

In such systems, the detection and location of a trainee's "shot" is often accomplished through use of a simulated weapon that works in conjunction with data acquisition equipment. The simulated weapon and data acquisition equipment may take on various forms. For example, in one prior art single-trainee system, the simulated weapon may employ a laser light source to generate a spot on the screen (or reflective surface) when the weapon is aimed and fired by the trainee. The weapon is not tethered to the data acquisition system by a cable, thereby enabling the trainee to move freely and unrestricted during the training exercise. The data acquisition equipment employs an area array image sensor, such as a CCD (Charge Coupled Device) camera, to detect and locate the position of the laser spot when it is directed upon the screen by the trainee. To accomplish these tasks, the CCD camera is aimed at the screen to constantly receive an updated image consisting of light reflected from the screen. Before entering the CCD camera, the reflected light passes through a filter that prevents passage of all light not having a wavelength equal to that of the laser light. Thus, only reflected light from the laser spot actually enters the CCD camera where it is imposed on a sensor surface comprised of individual CCD sensors arranged in a two-dimensional array (or row and column grid) like the discrete pixels on a computer monitor or television screen. When struck by the reflected light of the laser spot, the sensors produce an electrical signal corresponding to the intensity of the light received by the sensors. By scanning all of the sensors in the sensor array one row after another, the current image received by the CCD camera is converted into a plurality of discrete electrical signals or pixels. The presence and location of a laser spot is determined by subsequent analysis of the acquired pixel data.

Other firearms training systems enable multiple individuals to be trained simultaneously as a team using similar simulated weapons and data acquisition equipment. To detect and distinguish between multiple weapons that may be fired at the same time by multiple trainees, some systems employ simulated weapons having a laser light source which is modulated at a preset frequency. By modulating the lasers of the different weapons in the system at different preset frequencies, appropriate data acquisition equipment is able to distinguish a laser spot generated by one weapon from the laser spots generated by the other weapons. However, such systems are typically more expensive, less accurate, and less reliable than CCD-based systems. In addition, many multiple weapons training systems utilize weapons that are tethered to the data acquisition equipment, thereby restricting the movements of the individuals in the team being trained.

Therefore, there is a need in the industry for a method and an apparatus for simultaneously training multiple individuals using simulated weapons which address these and other related, and unrelated, problems.

SUMMARY OF THE INVENTION

Briefly described, the present invention comprises a method, with accompanying apparatus, for distinguishing a particular image shape and, hence, its associated source from other individually different, yet simultaneously-present image shapes in order to enable concurrent training of multiple individuals in a firearms training environment. In its various embodiments, the present invention selects a plurality of image shapes and defines certain parameters, related to measurable geometric and electromagnetic characteristics, which are readily computed from image data collected by an area array image sensor. Upon association of each image shape with a light source and subsequent non-concurrent generation of each image shape by its associated light source under controlled conditions (thereby producing a "control shape"), an analysis of the geometric and electromagnetic characteristics of captured shape data yields values for the defined parameters, known herein as "control parameters". The control parameters uniquely identify each control shape and, as a result of their association with a light source, the control parameters also uniquely identify the source of each control shape. Then, in order to identify an unknown, unique source of an "on-line shape" (i.e., a selected shape produced under simulation conditions), an analysis of the geometric and electromagnetic characteristics of collected shape data produces values for the defined parameters, known herein as "on-line parameters". By comparing the on-line parameters to the control parameters for each image shape, a "match" is found between the on-line parameters and the control parameters for an image shape, thereby identifying the on-line shape and, by association, its source.

More specifically, the present invention selects a plurality of image shapes, including, but not limited to: a first ellipse oriented with its major axis at a 45-degree angle to the right of the vertical direction; a second ellipse with its major axis at a 45-degree angle to the left of the vertical direction; a large circle; and, a small circle. For use in distinguishing the shapes, the present invention defines a plurality of shape parameters, including, but not limited to: spread; aspect ratio; area; slope; intensity; and, an overall rating derived from the combination of all the afore-listed parameters.

In accordance with a preferred method, an image shape is associated, or identified, with a light-emitting simulated weapon operating at a known wavelength and capable of generating a light beam having the associated image shape when its trigger is pulled by a trainee. Upon firing the simulated weapon at a reflective surface, both geometric and electromagnetic data are collected from the reflected light and are utilized to compute control parameters. In the preferred method, each simulated weapon is fired at different pre-defined regions of the reflective surface with the control parameters computed from each shot being averaged to create more accurate control parameters for each region of the reflective surface. By defining and utilizing control parameters in each region, the system compensates for differences in the amount of light intensity lost by light reflected from the center of the reflective surface and light reflected from the sides of the reflective surface. The resulting control parameters are then stored in computer memory for later use.

Next, each trainee randomly fires his simulated weapon at a target, thereby imposing the image shape associated with his weapon on the reflective surface. Each imposition of a image shape on the reflective surface constitutes an "on-line shot" and because trainees may fire at will, image shapes from different weapons are often simultaneously imposed on the reflective surface. Geometric and electromagnetic data corresponding to the on-line image shapes are collected and used to compute on-line parameters for each occurence of an on-line image shape. By subsequently comparing the on-line parameters for each occurrence of an on-line image shape to the previously stored control parameters for all image shapes in the appropriate region of the reflective surface, the simulated weapon that fired the shot is identified and, hence, the trainee using the weapon. In addition, by calculating the position of each on-line image shape and comparing its position relative to the target, the accuracy of the trainee's shots is determined. Each trainee's performance may be evaluated by displaying the target versus the location of the trainee's shots relative to the target, the total number of "hits" and "misses", and the amount of time elapsed before a shot was fired at the target.

In accordance with the preferred embodiment, a training video is projected on the reflective surface after control parameters are determined for each simulated weapon in each region of the reflective surface. Upon locating a potential target, or threat (i.e., a "bad" guy), each trainee fires his simulated weapon at the threat and geometric and electromagnetic data is collected for each on-line shot. After computation of on-line parameters and identification of the simulated weapon firing each on-line shot, each trainee's performance is evaluated as discussed above.

The preferred method of the present invention is performed through use of a preferred apparatus which comprises a simulation controller having a media interface that electrically connects the simulation controller to a media player such as, for example, a video tape or laser disk player. The simulation controller also includes a video/graphics interface to electrically connect the simulation controller to a projector. A reflective surface distant from the projector receives projected video images transmitted from the media player to the projector by the simulation computer and its interfaces. The reflective surface reflects the projected video images, but also reflects image shapes 40 imposed on the surface by a plurality of laser simulated weapons fired by trainees. An area array image sensor is aimed at the reflective surface and has a filter through which reflected light must pass before striking a plurality of discrete sensors located within and arranged in rows and columns. Because the filter passes only light having the same wavelength as that produced by the simulated weapons, any light striking the discrete sensors is most likely the reflection of an image shape generated by a weapon. The area array image sensor generates intensity data corresponding to the light of the image shape striking its discrete sensors and continually outputs the data one row at a time, thereby converting the light associated with the image shape into rows of pixel intensity data, or segments, bounded by the perimeter of the image shape. A data acquisition interface receives the pixel intensity data, including the relative position of each pixel, and generates output data for each segment of an image shape, including segment position, segment length, and segment intensity. The simulation controller receives the segment output data from the data acquisition interface and computes the parameters as described above.

In an alternate embodiment of the present invention, the same set of image shapes is produced by a second set of simulated weapons operating to produce light at a different wavelength. A second area array image sensor has a filter which filters out all light except that produced by the second set of simulated weapons. Data from the area array image sensor is output to a data acquisition interface substantially similar to the interface employed in the preferred embodiment. The method of the alternate embodiment is substantially the same as the method of the preferred embodiment.

Accordingly, it is an object of the present invention to simultaneously train multiple individuals in the use of firearms.

Another object of the present invention is to associate a simulated "shot" and its source.

Still another object of the present invention is to detect and distinguish between multiple image shapes simultaneously imposed on a reflective surface by a simulated weapon.

Still another object of the present invention is to identify a discrete source of each of a plurality of simulated "shots" from a plurality of simulated weapons.

Still another object of the present invention is to inexpensively and safely train individuals in the use of firearms.

Still another object of the present invention is to improve the judgment of individuals using firearms.

Still another object of the present invention is to enhance the firing accuracy of individuals using firearms.

Still another object of the present invention is to reduce the amount of time required for an individual to fire his weapon after being presented with a threat.

Other objects, features, and advantages of the present invention will become apparent upon reading and understanding the present specification when take in conjunction with the appended drawings.

BRIEF DESCRIPTION OF THE DRAWINGS

FIGS. 16A and 16B are a flow chart representation of the method utilized by the data acquisition interface to generate segment data for use by the interrupt handling methods of FIGS. 12 and 14.

FIG. 17 is a schematic representation of the output signal of the area array image sensor of FIG. 1.

FIG. 18 is a schematic representation of pixel intensity data present in the output signal of FIG. 17.

DETAILED DESCRIPTION OF THE PREFERRED EMBODIMENT

Figure 1:
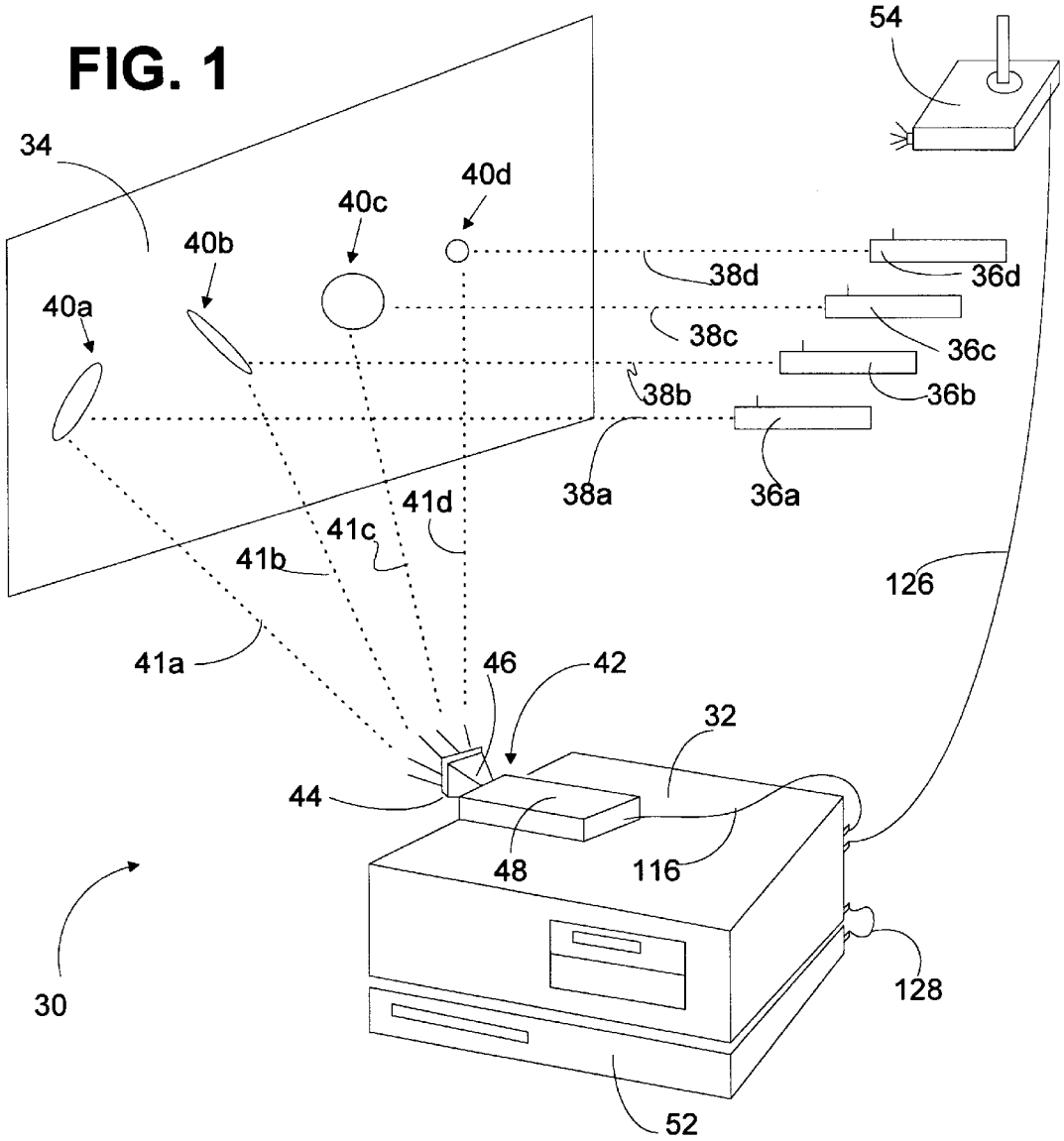
FIG. 1 is a schematic representation of a weapons simulation system in accordance with the preferred embodiment of the present invention.

Referring now to the drawings, in which like numerals represent like components throughout the several views, a weapons simulation system 30, in accordance with the preferred embodiment of the present invention, is shown in FIG. 1. The weapons simulation system 30 comprises a controller 32, a reflective surface 34, and a plurality of untethered simulated weapons 36. Preferably, the reflective surface 34 is a conventional movie screen, but may be a light-colored wall in an alternate embodiment. The simulated weapons 36, described in more detail below, generate a plurality of shaped light beams 38 of a pre-determined wavelength which eminate from the simulated weapons 36 when the triggers of the simulated weapons 36 are pulled by a trainee. The shaped light beams 38 produce a plurality of image shapes 40 on the reflective surface 34 including, a positive-sloped ellipse 40*a,* a negative-sloped ellipse 40*b,* a large circle 40*c,* and a small circle 40*d.* Each simulated weapon 36 produces a unique image shape 40 when fired by a trainee. Thus, simulated weapon 36*a* produces the positive-sloped ellipse 40*a;* simulated weapon 36*b* produces the negative-sloped ellipse 40*b;* simulated weapon 36*c* produces the large circle 40*c;* and, simulated weapon 36*d* produces the small circle 40*d.* Note that while particular image shapes are employed in the preferred embodiment, the selected image shapes are members of a species of image shapes that may be employed and in an alternate embodiment, other image shapes are produced by the light beams 38. The weapons simulation system 30 also includes an area array image sensor 42 which is aimed so as to receive reflected light 41 from the reflective surface 34. The area array image sensor 42 has a filter 44 and a lens 46, preferably a wide-angle lens, through which reflected light 41 passes before entering the body 48 of the sensor 42. The filter 44 is selected to allow passage of reflected light 41 having the same wavelength as the shaped light beams 38, while preventing passage of reflected light 41 having a different wavelength than the shaped light beams 38.

Figure 2:
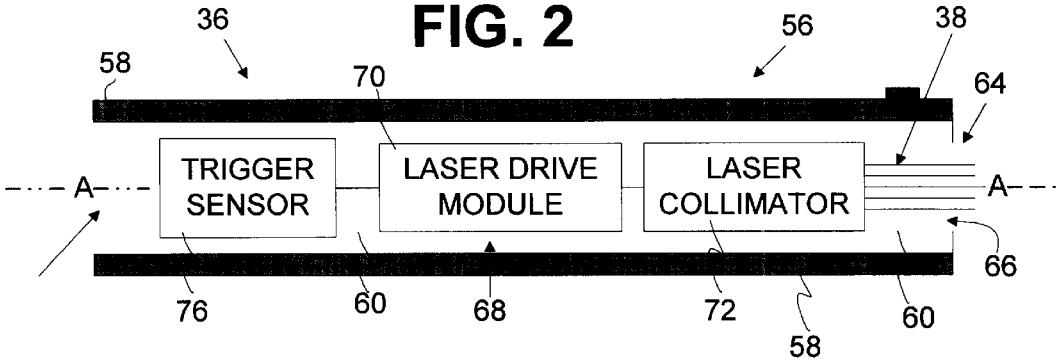
FIG. 2 is a schematic representation of the optical components of a simulated weapon of FIG. 1 which produces a circular image shape.

Each untethered simulated weapon 36 of the preferred embodiment includes a standard barrel 56, as shown schematically in FIG. 2, which has been modified to render the weapon unuseable as a conventional weapon. Preferably, each simulated weapon 36 and its barrel 56 is adapted from a standard 0.45 calibre pistol, which due to its size, provides more internal space for the receipt of simulation-related devices than other pistols. The barrel 56 has a wall 58 which defines a bore 60 having a first end 62 and a second end 64. A bore opening 66 is located at the second end 64 and communicates with the bore 60. A bore centerline, indicated by the letter "A", extends between the first end 62 and the second end 64. The bore 60 receives a laser assembly 68 which is mounted so as to enable a coherent light beam 38, emitted from the laser assembly 68, to exit the bore 60 through the bore opening 66 in a trajectory colinear with the bore centerline. The laser assembly 68 includes a laser drive module 70 and a laser collimator 72. The laser collimator 72 is mounted between the laser drive module 70 and the second end 64 of the bore 60 where it connects to the laser drive module 70. The laser collimator 72 has a laser diode which produces the light beam 38. A trigger sensor 76 is mounted between the laser drive module 70 and the first end 62 of the bore 60. The trigger sensor 76 is interconnected between the laser drive module 70 and the weapon's trigger to energize the laser drive module 70 upon detecting a pull of the trigger by a trainee. The laser drive module 70, laser collimator 72, and trigger sensor 76 are selected, preferably, from conventional devices well-known to those in the industry. Additionally, the laser drive module 70 is selected to produce a light beam 38 that is invisible, yet safe to the human eye. Note that the scope of the present invention is understood to encompass the use of light sources other than lasers.

Simulated weapons 36*c,d* include laser assemblies 68*c,d* of the type shown in FIG. 2. The laser assembly 68*c* of simulated weapon 36*c* includes a drive resistor (not shown) having a resistance, Rc, while the laser assembly 68*d* of simulated weapon 36*d* includes a drive resistor (not shown) having a resistance, Rd. The difference in the sizes of image shapes 40*c,d* produced by simulated weapons 36*c,d* is created by using a resistance, Rc, in weapon 36*c,* that is different from the resistance, Rd, in weapon 36*d.*

Figure 3:
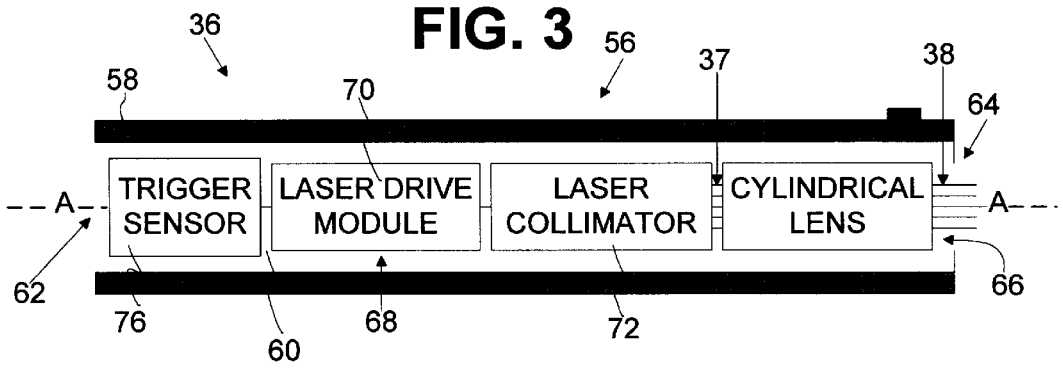
FIG. 3 is a schematic representation of the optical components of a simulated weapon of FIG. 1 which produces an elliptical image shape.

A schematic representation of simulated weapons 36*a,b* is shown in FIG. 3. Note that, for the most part, simulated weapons 36*a,b* include substantially the same components as simulated weapons 36*c,d* pictured schematically in FIG. 2. However, as seen in FIG. 3, simulated weapons 36*a,b* also include a cylindrical lens 78. The cylindrical lens 78 receives a coherent light beam 37 as it exits the laser collimator 72 and shapes the beam 37 to produce a light beam 38 which has an elliptical shape. By rotating the cylindrical lens 78*a* about centerline "A" in a clockwise direction (as determined by looking at the simulated weapon 36 from end 64), the positive-sloped ellipse 40*a* of FIG. 1 is generated by simulated weapon 36*a.* By rotating the cylindrical lens 78*b* about centerline "A" in a counterclockwise direction (as determined by looking at the simulated weapon 36 from end 64), the negative-sloped ellipse 40*b* of FIG. 1 is generated by simulated weapon 36*b.* Note that because the simulated weapons 36 are non-tethered, a trainee using a simulated weapon 36 may move about in a manner which is unrestrained by the cable which normally connects a weapon to a controller in a simulation system having tethered weapons. Also, note that in an alternate embodiment of the present invention, the laser assembly 68 is mounted external to the simulated weapon 36.

Referring back to FIG. 1, the weapons simulation system 30 further includes a video/graphics generation subsystem 50, the operation of which is controlled by the controller 32. The video/graphics generation subsystem 50 working in conjunction with the controller 32, generates graphics and prompts which are displayed on reflective surface 34. Additionally, the video/graphics generation subsystem 50 enables training scenarios, including vignettes, to be projected onto the reflective surface 34. In accordance with the preferred embodiment of the present invention, the video/graphics generation subsystem 50 includes a conventional video tape player 52 and a conventional projector 54. In alternate embodiments, the video/graphics generation subsystem 50 (see FIG. 4) includes laser disk players, digital video players, and other video/graphics generation devices.

Figure 4:
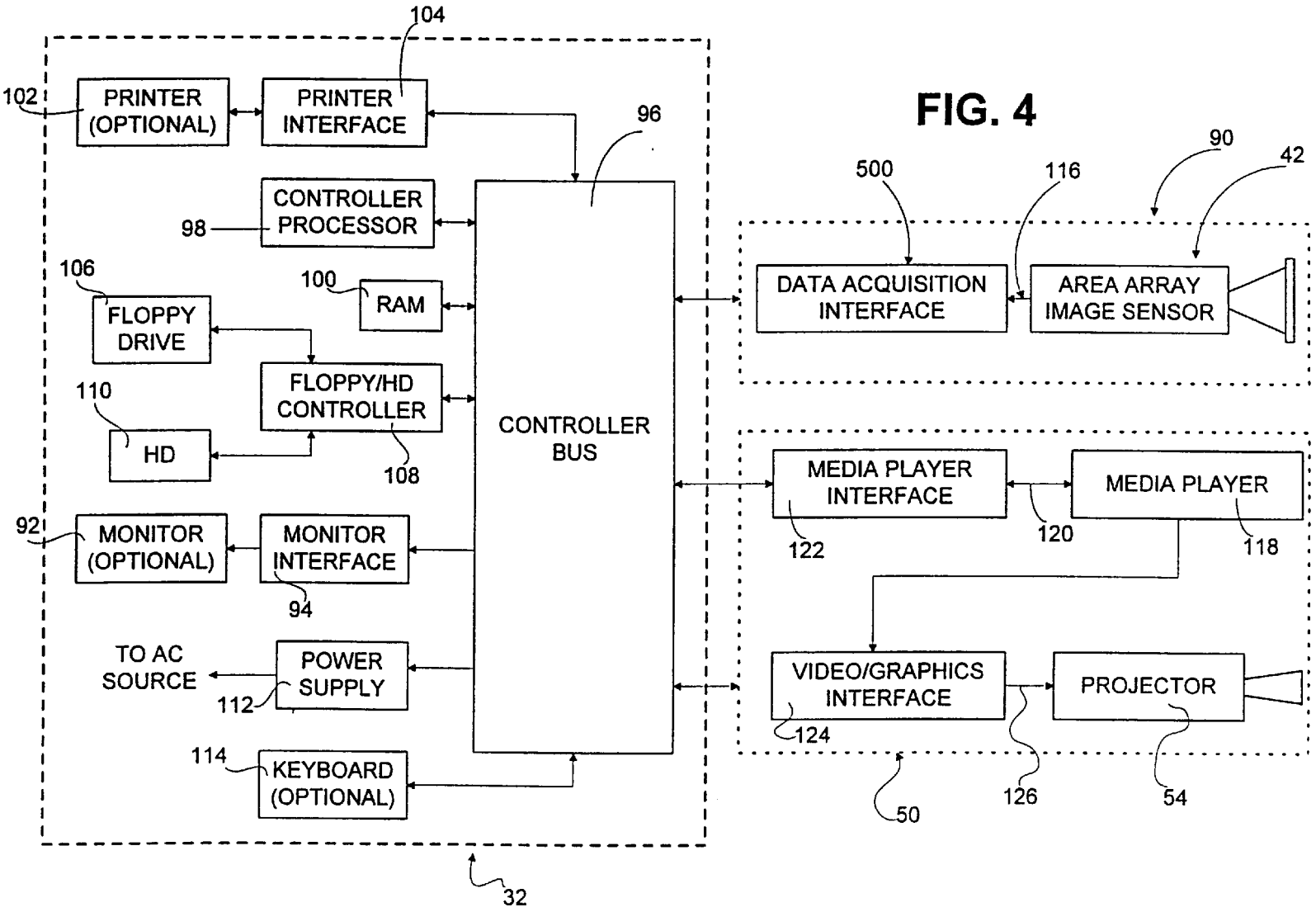
FIG. 4 is a block diagram representation of the controller, data acquisition subsystem, and video/graphics subsystem of the weapons simulation system of FIG. 1.

FIG. 4 shows a block diagram representation of the controller 32, a segment data acquisition subsystem 90, and a video/graphics generation subsystem 50 in accordance with the preferred embodiment of the present invention. The controller 32 is shown connected to an optional monitor 92 through a monitor interface 94 which is connected to a controller bus 96. A controller processor 98 and a random access memory (RAM) 100 are also shown connected to the controller bus 96. An optional printer 102 is shown connected to the controller bus 96 through a printer interface 104. A floppy drive 106 is shown connected to the controller bus 96 through a floppy/hard drive controller 108 which is also connected to a hard drive 110. A power supply 112 connects the controller to an AC source, and a trainee may attach an optional keyboard 114 for control, maintenance, testing, etc. The segment data acquisition subsystem 90 comprises an area array image sensor 42 which is electrically connected to the controller bus 96 through a cable 116 and a data acquisition interface 500. The data acquisition interface 500 comprises a circuit board of electronic components which connects directly to the controller bus 96. The video/graphics generation subsystem 50 includes a media player 118, as discussed above, which is connected via cable 120 to a media player interface 122. The media player interface 122 connects directly to the controller bus 96. The video/graphics generation subsystem 50 further includes the projector 54, shown in FIG. 1, and a video/graphics interface 124 which connects to the controller bus 96. The video/graphics interface 124 connects via cable 126 to the projector 54 and to the media player 118 by cable 128.

The area array image sensor 42, as shown in FIG. 1, is oriented with its lens 46 opening toward the reflective surface 34. In accordance with the preferred embodiment of the present invention, the area array image sensor 42 is a conventional CCD-camera, however, in alternate embodiments, other apparatus capable of producing rasterized output intensity representations of an image are acceptable as well. As light (including light projected by the projector 54 and light produced by the simulated weapons 36) incident upon the reflective surface 34 is reflected by the reflective surface 34, the area array image sensor 42 receives the reflected light 41. The filter 44 prevents all light, except that having the same wavelength as that of the light beams 38, from entering the area array image sensor 42. Thus, for the most part, only the reflections of light beams 38 produced by the simulated weapons 36 actually enter the body 48 of the area array image sensor 42. Once inside the body 48, the reflected light 41, including image shapes 40, the area array image sensor 42 converts the light into an analog output signal 700 comprised of rows which include intensity data.

Figure 5:
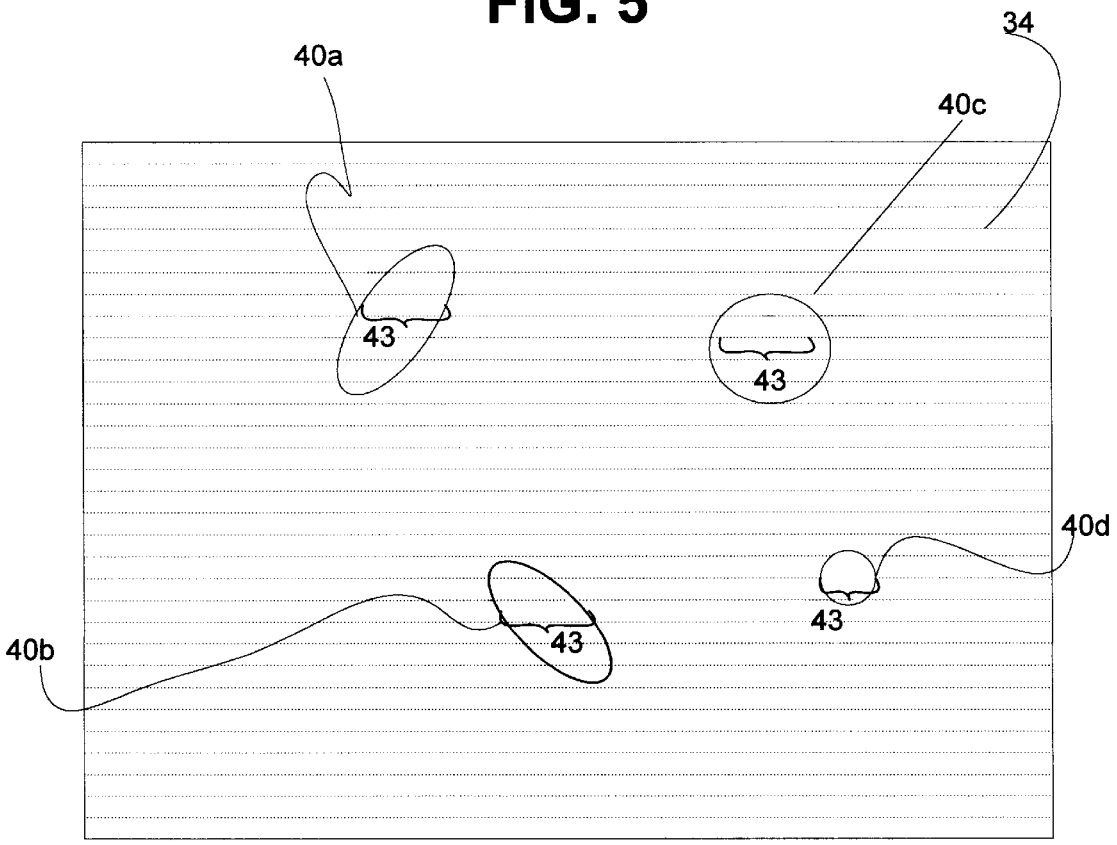
FIG. 5 is a schematic representation of the reflected light received from the reflective surface by the area array image sensor of FIG. 1, showing the image shapes superimposed on the rows and columns of light pixels to define segments of pixels within the boundaries of the image shapes.

Referring now to FIG. 5, the area array image sensor 42 essentially "pixelizes" the entire reflective surface 34 into rows and columns of pixel intensity data representing the light received from the reflective surface 34. In FIG. 5, the image shapes 40 are superimposed upon the rows and columns of pixel intensity data. As seen, the reflected light of each image shape 40 is divided by the area array image sensor 42 into rows of pixels which reside within the boundaries of the image shapes 40, herein referred to as "segments" 43. Thus, each image shape 40 is comprised of multiple segments 43 of pixel intensity data. By extracting the segment pixel data, or simply segment data, from the analog signal 700 output by the area array image sensor and computing control and on-line values for various shape parameters, the image shapes 40 (and, hence, the simulated weapon 36 producing each image shape 40) are identifiable as discussed below.

Figure 6:
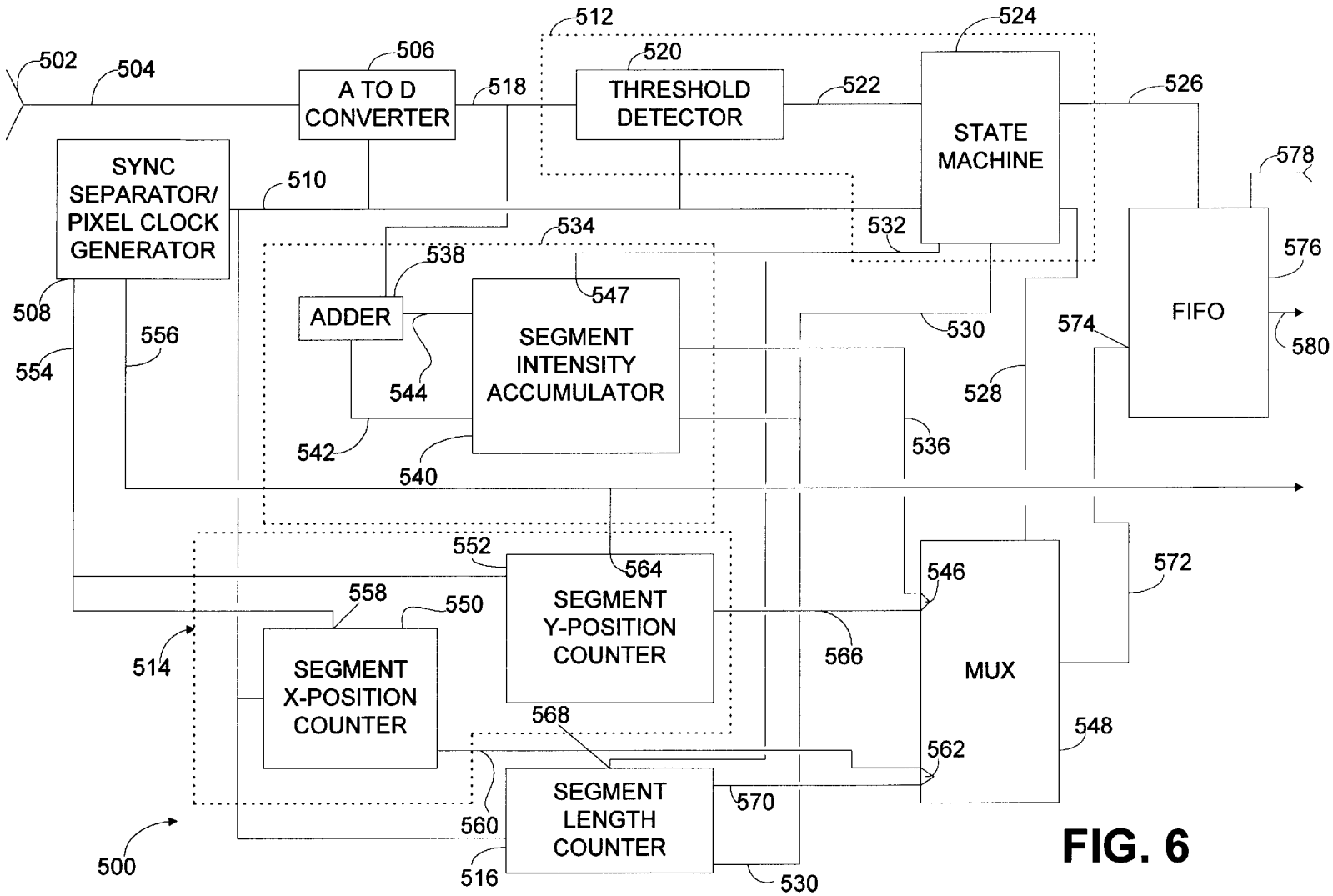
FIG. 6 is a block diagram representation of the data acquisition interface in accordance with the present invention.

The data acquisition interface 500 of the present invention extracts the segment pixel data, a first category of data, from the analog signal 700 output from the area array image sensor 42 to produce a second category of data for each segment 43 of an image shape 40 detected from the analog signal 700. In accordance with the preferred embodiment, the segment data includes the segment's x-position and y-position (also referred to as x/y position), length, and intensity. FIG. 6 displays a block diagram representation of the data acquisition interface 500 in accordance with the preferred embodiment of the present invention. The data acquisition interface 500 is connected through image sensor connector 502 to the output cable 116 of the area array image sensor 42 (see FIG. 1). Analog data line 504 connects the image sensor connector 502 to an A-to-D converter 506 and to a sync separator/pixel clock generator 508. A pixel clock signal is produced by the sync separator/pixel clock generator 508 and is output on pixel clock line 510 to the A-to-D converter 506, to a spot detector 512, to a segment position counter 514, and to a segment length counter 516. The pixel clock signal clocks data through the A-to-D converter 506, thereby causing the conversion of data on analog data line 504 to digital form on intensity data input line 518. The spot detector 512 includes a threshold detector 520 which is connected to intensity data input line 518 for receipt of digital intensity data when clocked by the pixel clock signal on pixel clock line 510. The threshold detector 520 compares the intensity data on intensity data input line 518 against a predetermined level to ascertain whether or not image shape (also referred to herein as "spot") data is present and to create a representative signal on threshold status line 522. The spot detector 512 also includes a state machine 524 which is connected to threshold status line 522 to receive input when clocked by the pixel clock signal on pixel clock line 510. The state machine 524 determines whether the spot data is in a spot and whether a previously detected spot has been exited. Upon making its determination, the state machine 524 generates appropriate output signals on FIFO write line 526, MUX select line 528, clock enable line 530, and clear line 532.

The data acquisition interface 500 also includes a segment intensity totalizer 534 which receives intensity data on intensity data input line 518 and outputs a segment's total intensity on intensity output line 536. The segment intensity totalizer 534 includes an adder 538 and a segment intensity accumulator 540. The adder 538 is connected to intensity data input line 518 for receipt of new intensity data and to intermediate total line 542 for receipt of an intermediate intensity total from the segment intensity totalizer 534. The adder 538 is connected to the segment intensity accumulator 540 by adder output line 544. The segment intensity accumulator 540 stores the intermediate intensity total present on adder output line 544 when enabled by clock enable line 530 from the state machine 524. Intensity output line 536 connects the segment intensity accumulator 540 to input port 546 of multiplexor (also referred to herein as MUX) 548, thereby enabling the transfer of a segment's total intensity to the multiplexor 548. A clear input 547 of the segment intensity accumulator 540 connects to the state machine 524 via clear line 532 to enable clearing of the intermediate intensity total held by the segment intensity accumulator 540.

The sync separator/pixel clock generator 508 extracts horizontal and vertical sync pulses from the input data present on analog data line 504 to generate horizontal and vertical signals on horizontal sync line 554 and vertical sync line 556, respectively. Horizontal and vertical sync lines 554, 556 connect to the segment position counter 514. More specifically, the segment position counter 514 includes a segment x-position counter 550 and a segment y-position counter 552. The segment x-position counter 550 has a clear input 558 which connects to the horizontal sync line 554, thereby enabling the presence of a horizontal sync signal to clear the segment x-position counter 550. The segment x-position counter 550 also connects to the pixel clock line 510. Upon receipt of a pixel clock pulse, the segment x-position counter 550 is incremented. An x-position output line 560 connects the segment x-position counter 550 to input port 562 of multiplexor 548 to enable transfer of a segment's x-position to the multiplexor 548. The horizontal sync line 554 also connects to the segment y-position counter 552 so that the segment y-position counter 552 is incremented upon receipt of a horizontal sync pulse. The segment y-position counter 552 has a clear input 564 which connects to vertical sync line 556 to enable clearing of the segment y-position counter 552 upon receipt of a vertical sync pulse. A y-position output line 566 connects the segment y-position counter 552 to input port 546 of the multiplexor 548.

The segment length counter 516 includes a clear input 568 which is connected to clear line 532 from the state machine 524. The segment length counter 516 is cleared when a low signal pulse is received on clear line 532. Clock enable line 530 also connects the segment length counter 516 to the state machine 524 and enables the segment length counter 516 to be incremented upon receipt of a pixel clock pulse on pixel clock line 510. A length counter output line 570 connects the segment length counter 516 to input port 562 of the multiplexor 548 to allow transfer of segment length data when necessary.

Multiplexor 548 selects data from input port 546 or input port 562 depending on the signal of mux select line 528 as set by the state machine 524. When input port 546 is selected, the mux, preferably, receives 7 bits of segment intensity data and 9 bits of segment y-position data. When input port 562 is selected, the mux, preferably, receives 10 bits of segment x-position data and 6 bits of segment length data. A mux output line 572 connects the multiplexor 548 to an input port 574 of a FIFO (First-In, First-Out) buffer 576. The FIFO accepts data on mux output line 572 when an appropriate signal is imposed on FIFO write line 526. A FIFO read enable line 578 and FIFO output lines 580 connect the FIFO 576 to the controller bus 96. When an appropriate signal is placed on FIFO read enable line 578 by the controller 32, the FIFO 576, preferably, places 16 bits of data on FIFO output lines 580 for transfer to the controller 32.

The sync separator/pixel clock generator 508 also connects to the controller bus 96, via vertical sync line 556. When a vertical sync pulse is present on vertical sync line 556, the controller 32 is interrupted to enable the controller 32 to read and process the segment data present in the FIFO buffer 576.

Figure 7:
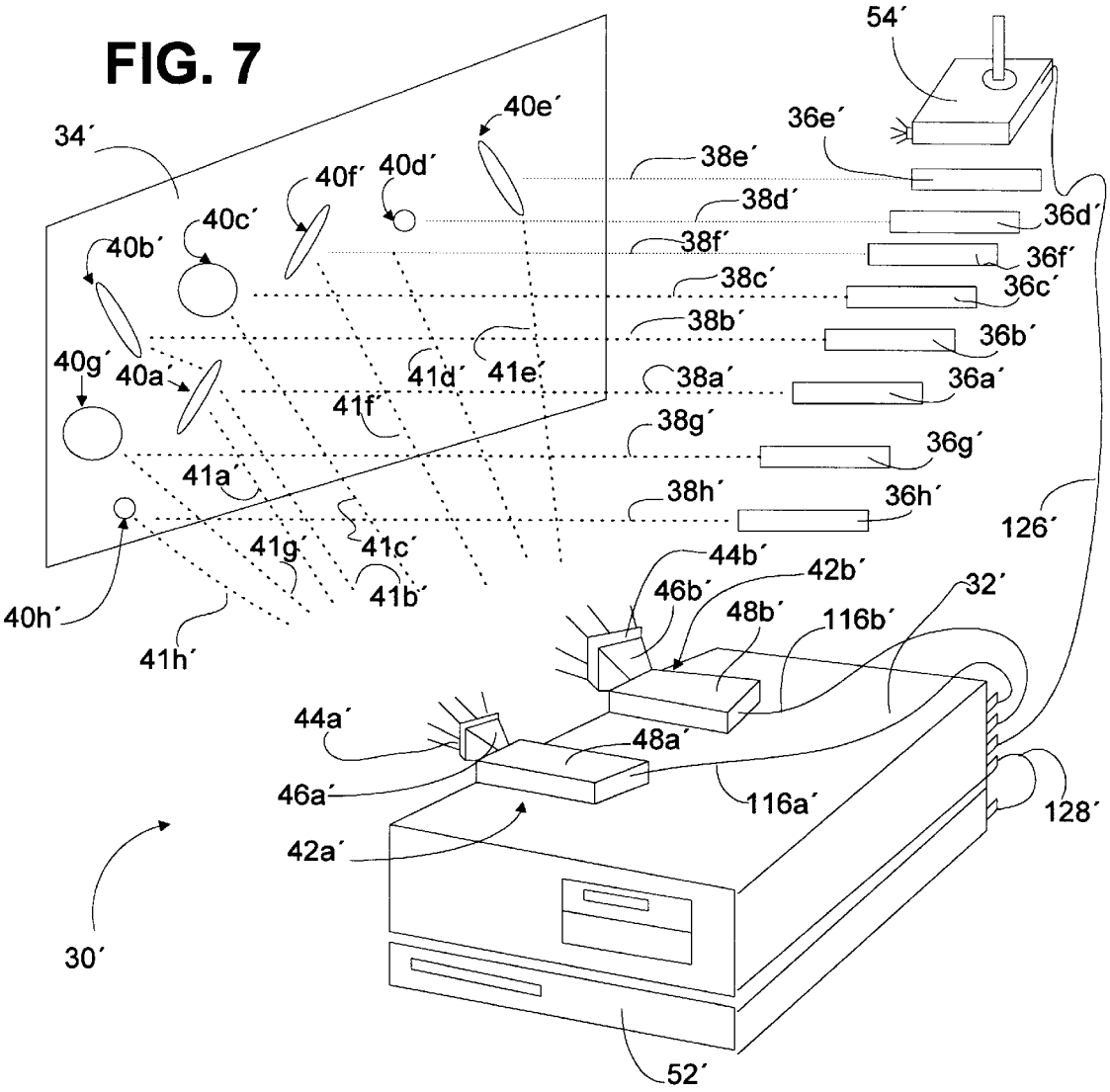
FIG. 7 is a schematic representation of a weapons simulation system which enables the use of an expanded number of simulated weapons, using the same basic image shapes, in accordance with an alternate embodiment of the present invention.
Figure 8:
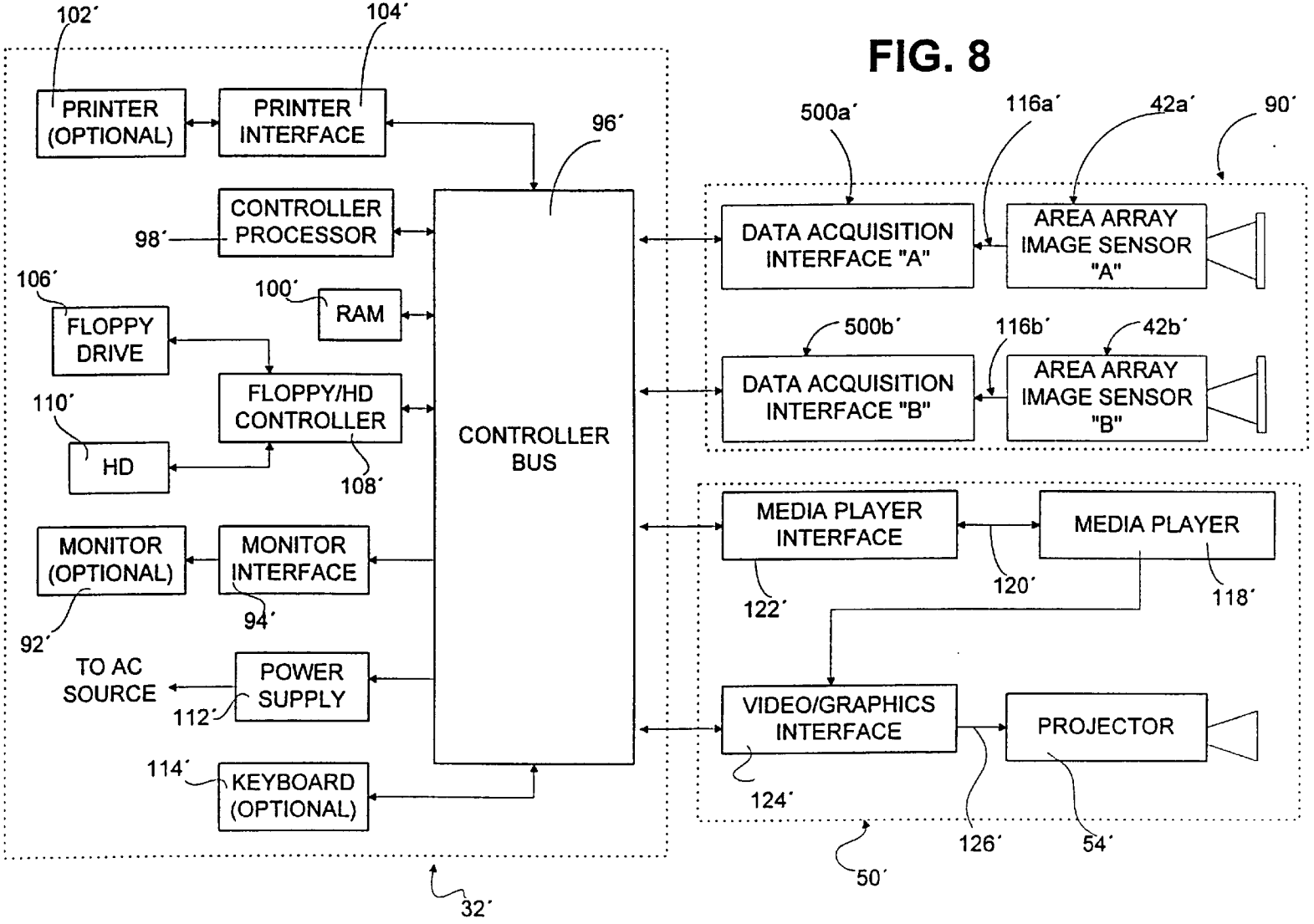
FIG. 8 is a block diagram representation of the controller, data acquisition subsystem, and video/graphics subsystem of the weapons simulation system of FIG. 7.

In accordance with the preferred embodiment, only four images shapes 40 are utilized and detected by the weapons simulation system 30. Thus, only four trainees may be trained at a time. In an alternate embodiment of the present invention, a weapons simulation system 30' enables simultaneous training of up to eight trainees. As shown in FIGS. 7 and 8, the weapons simulation system 30' comprises a first group of simulated weapons 36*a,b,c,d'* and a second group of simulated weapons 36*e,f,g,h'*. Simulated weapons 36*a,b,c,d'* of the first group generate light beams 38*a,b,c,d'* having a first wavelength, L1, while simulated weapons 36*e,f,g,h'* of the second group generate light beams 38*e,f,g,h'* having a second wavelength, L2, which differs sufficiently from wavelength, L1, to enable differentiation of the light beams 38'. The weapons simulation system 30' also includes area array image sensors 42*a,b'* having filters 44*a,b'*. Because filter 44*a'* allows passage only of light having wavelength, L1, area array image sensor 42*a'* acquires segment data for simulated weapons 36*a,b,c,d'* and provides analog data to data acquisition interface "A" 500*a'*. Similarly, because filter 44*b'* allows passage only of light having wavelength, L2, area array image sensor 42*b'* acquires segment data for simulated weapons 36*e,f,g,h'* and provides analog data to data acquisition interface "B" 500*b'*. Thus, by utilizing simulated weapons 36 employing different wavelengths and multiple area array image sensors 42 having filters 44 matched appropriately to the different wavelengths, weapons simulation system 30' may simultaneously train up to eight trainees. Note that the scope of the present invention is understood to include combining data acquisition interface "A" 500*a'* and data acquisition interface "B" 500*b'* into a single data acquisition interface. In other alternate embodiments of the present invention, more than eight trainees may be simultaneously trained by expanding the weapons simulation system to include simulated weapons in groups of four (because only four image shapes are utilized per group) and an area array image sensor for each additional group of weapons. In still other alternate embodiments, more than four image shapes may be employed.

Figure 9:
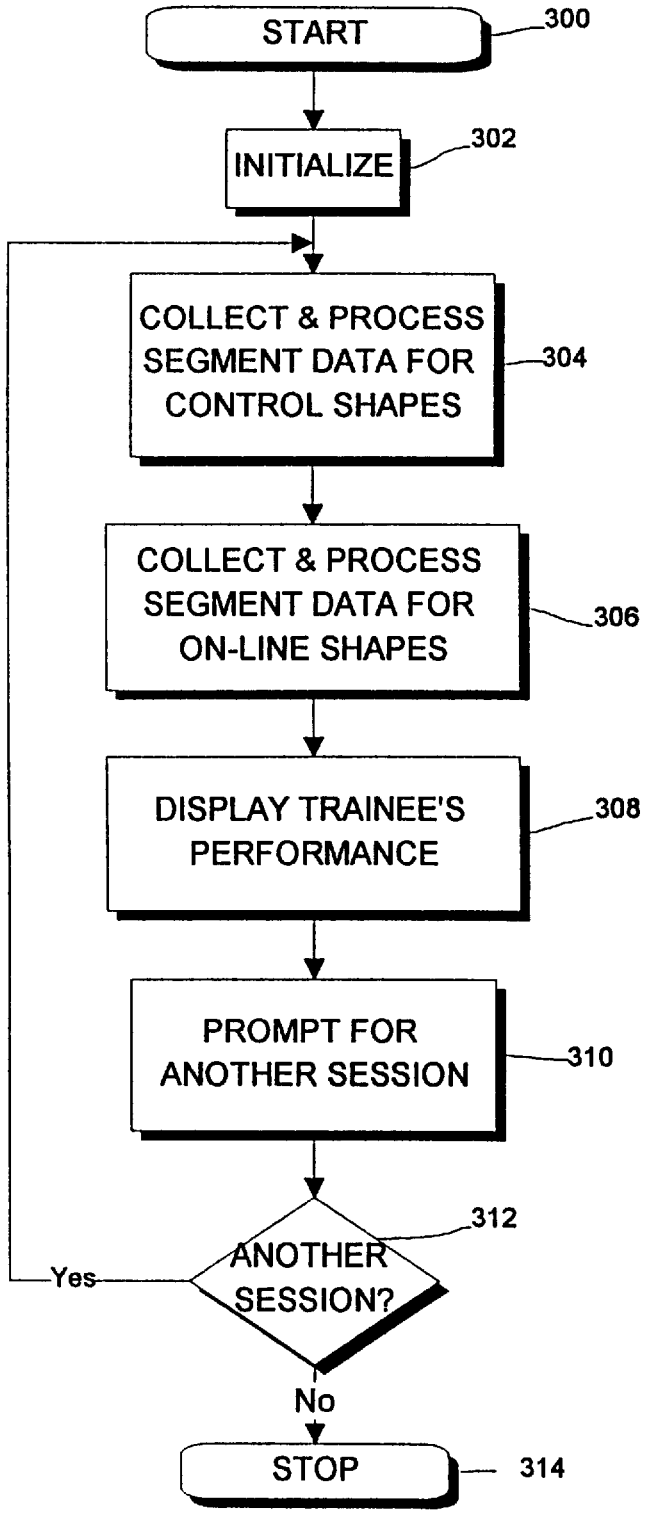
FIG. 9 is a flow chart representation of the controller foreground method in accordance with the present invention.

In accordance with a preferred method of the present invention, FIG. 9 displays the steps, performed by the forgoing process of the controller 32, which are necessary to simultaneously train multiple trainees using the preferred apparatus described above. The method starts at step 300 and proceeds to step 302 where various system variables and data structures are initialized. Then, the method advances to step 304 where control data is collected and processed for each simulated weapon 36 and, hence, for each image shape 40, which is to be used during the training session. Briefly, the substeps of step 304, described below, include methods to collect segment data for each image shape 40 by prompting each trainee to fire his simulated weapon 36 at various regions 902 and subregions 900 of the reflective surface 34. As the segment data is collected, the control parameters are computed and stored in the controller RAM 100 for later use. After collecting and processing control data, the method, at step 308, collects and processes on-line data for all of the simulated weapons 36 used by the trainees while a simulation scenario is projected onto the reflective surface 34. The substeps of step 308, described below, include methods to collect on-line segment data for each image shape 40 that is imposed on the reflective surface 34 by a trainee firing his simulated weapon 36 at potential targets presented by the simulation scenario. As the segment data is collected, the on-line parameters are computed and stored, with the segment data, in data structures set up in controller RAM 100 for each image shape 40. Upon comparison of the on-line parameters of each on-line image shape 40 40, resulting from a trainee's firing of a simulated weapon 36, to the previously determined control parameters for the region of the reflective surface 34 from which the on-line data was collected, each on-line image shape 40 40 is identified and associated with a trainee's simulated weapon 36. Also, each "shot" is evaluated as a "hit" or a "miss". Once on-line data has been collected and processed, the method moves to step 308 where each trainee's performance is evaluated by accumulating totals for the numbers of "hits" and "misses". Additionally, step 308 displays the accumulated totals with the location of each trainee's "shots" superimposed upon the potential target of the training scenario. Then, the method prompts a trainee, at step 310, to determine whether or not the trainee desires to try another training session. If yes, the method loops back to step 304 to collect and process control data. If no, the method terminates at step 314.

Figure 10:
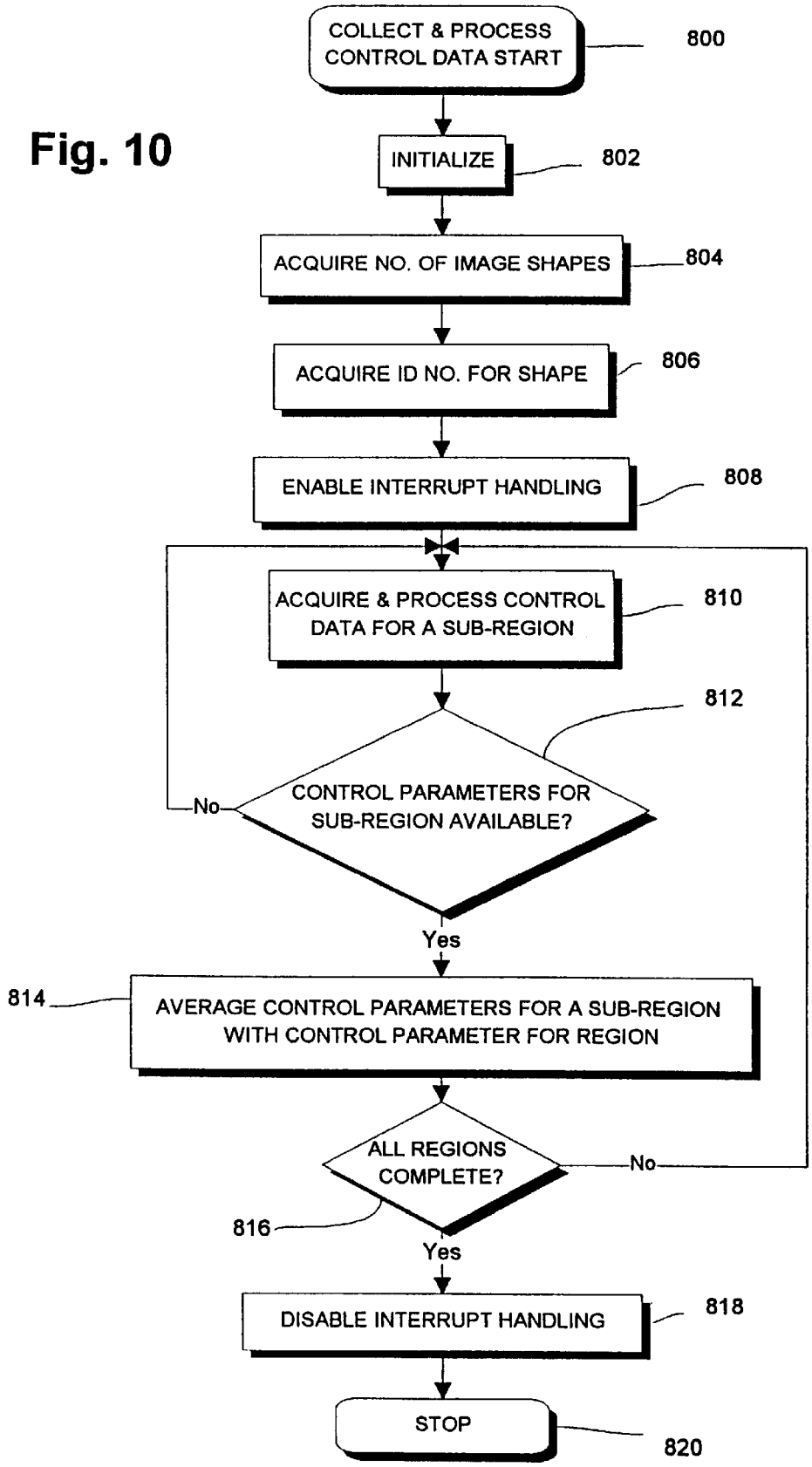
FIG. 10 is a flow chart representation of the method of collecting and processing the control data of FIG. 9.

FIG. 10 displays a flow chart representation of the method of collecting and processing control data for the image shapes 40. The method starts at step 800 immediately after a training simulation exercise has begun at step 300 (see FIG. 9). At step 802, the method initializes various internal variables and arrays in controller RAM 100 for storing collected and processed control data. After initialization is complete, the method continues and, at step 804, acquires the number of image shapes 40 (i.e., the number of simulated weapons 36) to be used during the training exercise by utilizing the video/graphics interface 124, projector 54, and reflective surface 34 to display a prompt for trainee input. Upon receiving the number of image shapes 40 from a trainee, the method proceeds to step 806 where it acquires an identification number for the shape (i.e., an identification number for the simulated weapon 36) for which control data is to be collected and processed in subsequent steps. The acquisition of an identification number again utilizes the video/graphics interface 124, projector 54, and reflective surface 34 to display a prompt for trainee input.

Figure 11:
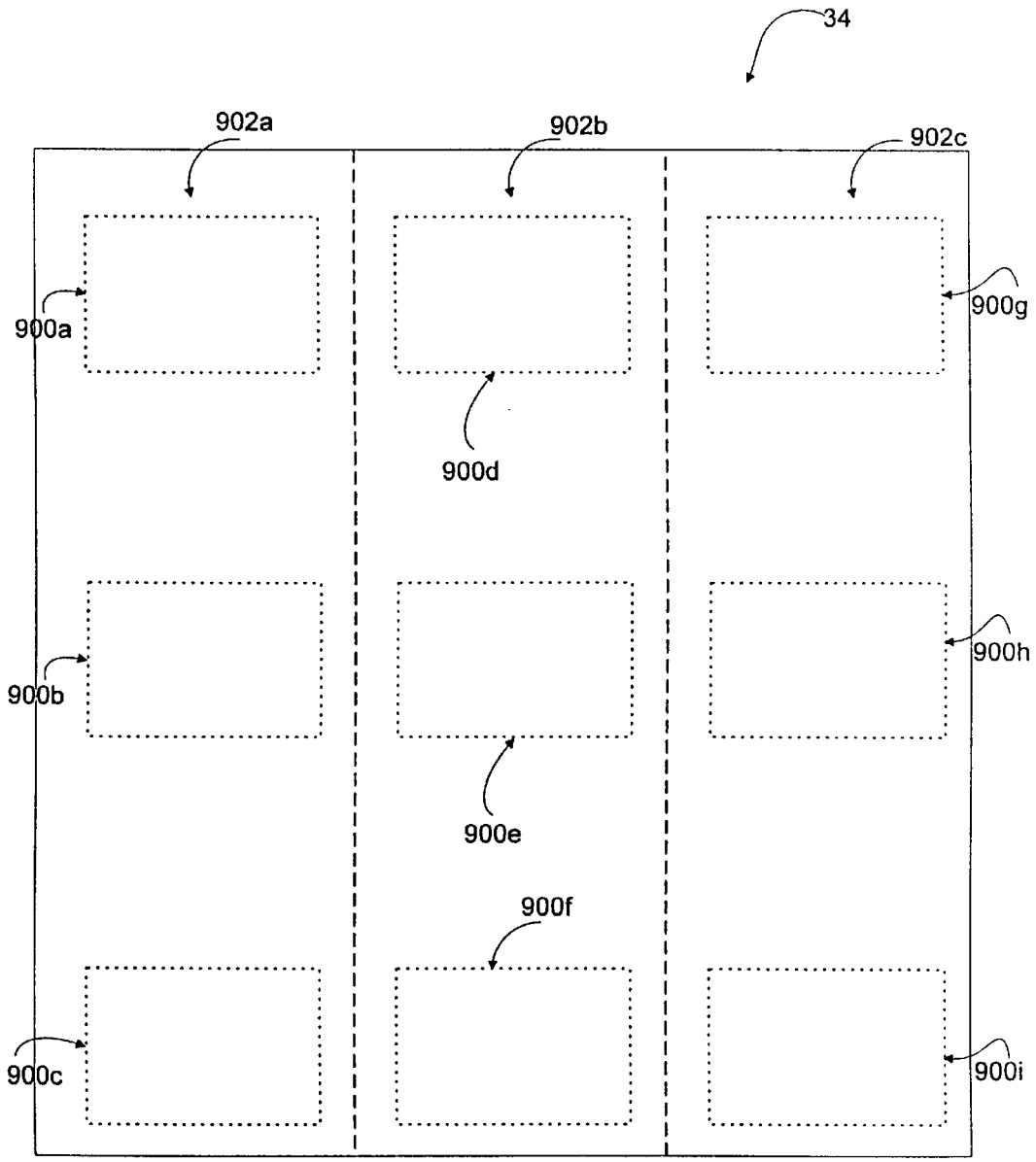
FIG. 11 is a schematic representation of the regions and subregions utilized during acquisition of the control data of FIG. 10.

Upon receiving an identification number for the shape, the method proceeds to step 808 where controller interrupt handling of interrupts generated by the data acquisition interface 500 is enabled. Thus, until interrupt handling is disabled below, the controller 32 is interrupted by the data acquisition interface 500 at the end of each frame of data acquired from the area array image sensor 42 so that the controller 32 can read segment data from the FIFO buffer 576 by enabling read enable line 578. Once interrupt handling is enabled, the method moves to step 810 and prompts a trainee to fire his simulated weapon 36 (i.e., the simulated weapon 36 for which control data is being collected and processed) by displaying a target box to delineate a sub-region 900 (see FIG. 11) on the reflective surface 34 using the video/graphic interface 124 and the projector 54. In an alternate embodiment, the target box is positioned mechanically in front of the reflective surface 34. As shown in FIG. 11, the sub-regions 900 are defined within regions 902 of the reflective surface 34. In accordance with the preferred method, the reflective surface 34 is logically divided into three regions 902 with each region 902 having three vertically arranged sub-regions 900. After prompting a trainee to fire his simulated weapon 36 at a sub-region 900, the method checks, at decision step 812, to see if control parameters are available for the sub-region 900 (remember control data is collected and control parameters are computed by the control data interrupt handler method which executes when the controller 32 receives an interrupt from the data acquisition interface 500). If no, then the trainee has either not fired his simulated weapon 36 at the sub-region 900 or the detected shape's parameters are not consistant with previous accepted shape parameters for the sub-region 900 (perhaps due to a faulty light source) and the method loops back to step 810 and the trainee is prompted again to fire his simulated weapon 36 at the sub-region 900. If yes, the method continues to step 814 where the control parameters for the sub-region 900 are averaged with the control parameter for the region 902 in which the sub-region 900 resides. Next, the method determines, at step 816, whether or not control parameters have been computed for all regions 902 of the reflective surface 34. If no, the method loops back to step 810 to acquire and process control data for another sub-region 900. If yes, the method continues to step 818 where interrupt handling is disabled (so that interrupts from the data acquisition interface 500 are ignored), thereby completing the acquisition and processing of control data for the shapes so that the method returns, at step 820, to the foreground process of the controller 32 and continues at step 306.

Figure 12:
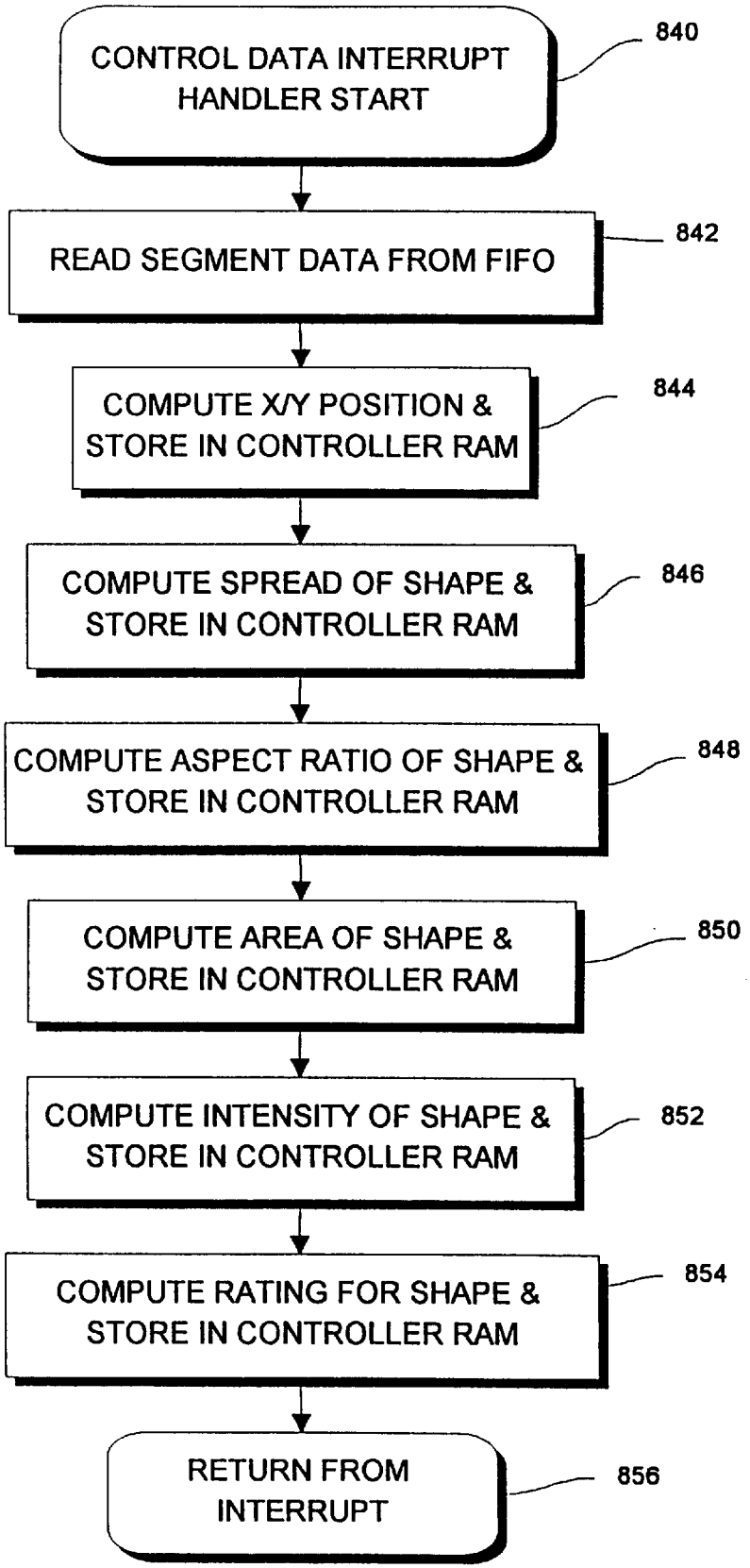
FIG. 12 is a flow chart representation of the control data interrupt handling method used by the method of FIG. 10 to collect and process control data.

FIG. 12 displays a flow chart representation of the control data interrupt handling method in accordance with the preferred embodiment of the present invention. The method starts at step 840 upon interrupt handling enabled and the controller 32 being interrupted by the data acquisition interface 500. At step 842, the controller 32 reads segment data from the FIFO buffer 576 into an intermediate data structure in controller RAM 100 by enabling the FIFO read enable line 578 so that the FIFO buffer 576 places data on its output lines 580. Because simulated weapons 32 are fired at the reflective surface 34 one at a time during control data acquisition and processing, all of the segment data read from the FIFO buffer 576 pertains to the image shape 40 for which values of control parameters are being computed.

After reading the segment data at step 842, the method advances to step 844 where the x/y position of the image shape is computed and stored in an intermediate data structure in controller RAM 100. The x/y position of an image shape 40 is, preferably, the x/y position of the center pixel (or the pixel closest to the center) of the image shape 40. Next, the method computes and stores the spread of the image shape 40, at step 846, in an intermediate data structure in controller RAM 100. Preferably, the spread of an image shape 40 is determined by selecting the greatest of (1) the maximum segment length of the image shape 40; (2) a first diagonal of the image shape 40; and, (3) a second diagonal of the image shape 40. Note that each diagonal begins at the uppermost segment and ends at the lowermost segment. Once the spread is computed and stored, the method, at step 848, computes and stores the aspect ratio of the image shape 40. If the image shape's maximum segment length is greater than the number of segments in the shape plus the minimum pixel size to classify it as a shape, the aspect ratio is computed as the spread divided by the number of segments in the shape plus the minimum pixel size to classify it as a shape. Otherwise, the aspect ratio is computed as the spread divided by the maximum segment length. The method then advances to step 850 to compute and store the area of the image shape 40 in an intermediate data structure in controller RAM 100. The area is computed by summing the lengths of all the segments in the image shape 40. Upon completion of step 850, the method computes and stores the intensity of the image shape 40, at step 852, in an intermediate data structure in controller RAM 100. The intensity of the image shape 40 is calculated by summing the intensity of each segment of the image shape 40. After storing the image shape intensity, the method, at step 854, computes and stores a rating for the image shape 40 in an intermediate data structure in controller RAM 100. Preferably, the image shape 40 is classified into a first group or a second group by considering its aspect ratio. If the image shape 40 has an aspect ratio greater than two, the image shape 40 is an ellipse and is placed in the first group. The slope of the image shape 40 is then computed. If the slope is negative, the image shape 40 rating is assigned a negative value. If the slope is positive, the image shape 40 rating is assigned a positive value. On the other hand, if the image shape 40 has an aspect ratio not greater than two, the image shape 40 is placed in the second group and is assigned a rating based upon a weighted sum of the shape's area, spread, and intensity. Weighting factors are previously determined by trial and error testing in an off-line environment and are selected to create a repeatable rating for each simulated weapon and image shape 40 in all regions of the reflective surface 34. Upon completion of step 854, the method advances to step 856 where it returns from the control data interrupt handling method to the collect and process control data method.

Figure 13:
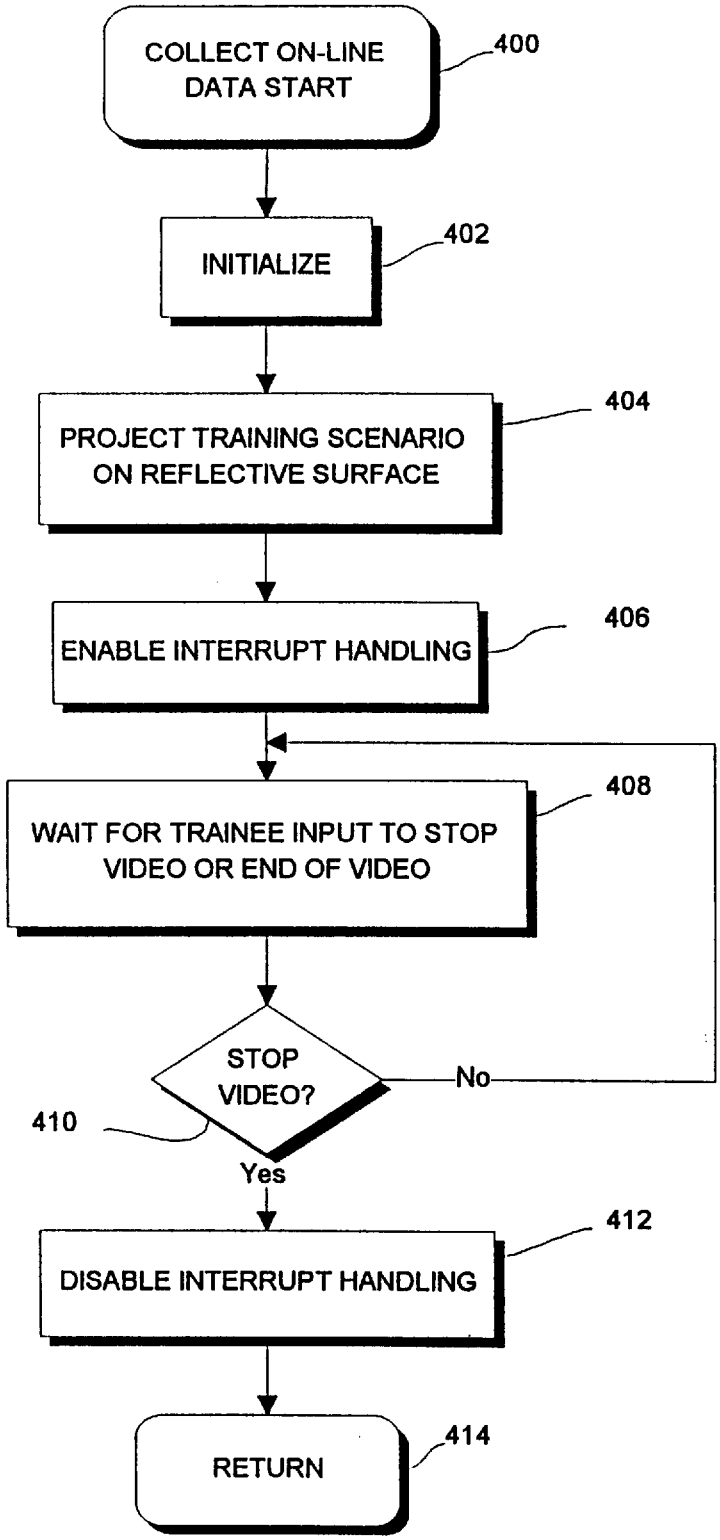
FIG. 13 is a flow chart representation of the method of collecting and processing the on-line data of FIG. 9.

FIG. 13 shows a flow chart representation of the method employed in the preferred embodiment to collect and process on-line data. The method starts at step 400 and proceeds by initializing variables and intermediate shape data structures, at step 402, for each type of shape being used in the simulation exercise. After initialization is completed, a training scenario is projected onto the reflective surface 34, at step 404, through use of the media player 118, the media interface 122, the video/graphics interface 124, and the projector 54 working in conjunction with the controller 32. Then, at step 406, on-line interrupt handling is enabled and all trainees randomly fire their simulated weapons 36 at the reflective surface 34 while the scenario is being shown to the trainees. The method advances to step 408 where it determines whether or not to stop the scenario, either because a trainee has prematurely stopped the training scenario or because the scenario has reached its end. At decision block 410, the method loops back to step 408 if the scenario is not to be stopped and continues to step 412 if the scenario is to be stopped. Upon reaching step 412, the method disables on-line interrupt handling to prevent the collection and processing of further segment data. Once on-line interrupt handling is disabled, the method, at step 414, returns to the controller foreground method at step 308.

Figure 14:
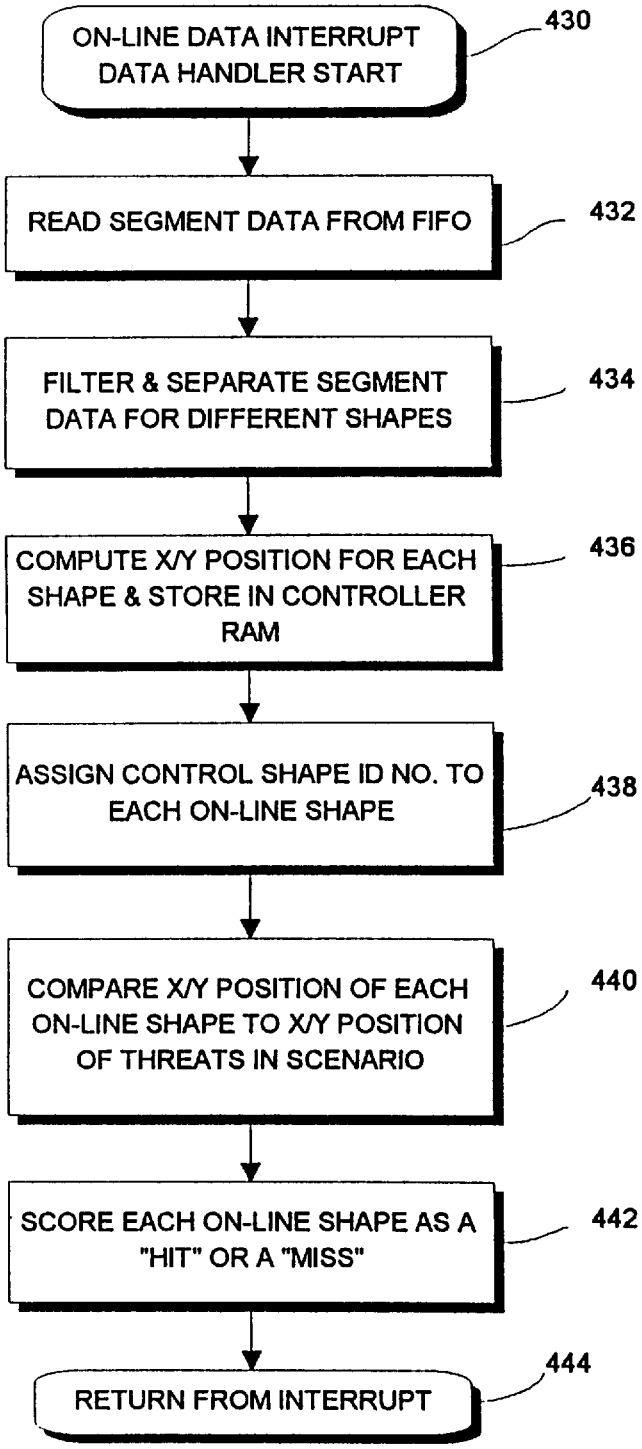
FIG. 14 is a flow chart representation of the on-line data interrupt handling method used by the method of FIG. 13 to collect and process on-line data.

The preferred method of on-line data interrupt handling is displayed by FIG. 14. The method starts at step 430 when the data acquisition interface 500 generates an interrupt via vertical sync line 556, thereby indicating that a frame of on-line segment data is available in the FIFO buffer 576 for transfer to controller RAM 100 and subsequent processing. After starting, the method reads on-line segment data from the FIFO buffer 576, as described above with reference to the reading of control segment data, into an intermediate data structure in controller RAM 100 at step 432. Note, however, that the on-line segment data may contain intermixed segment data for all of the image shapes 40 being utilized during the training scenario, but may contain segment data for only one occurrence of a particular image shape 40. Therefore, the method, at step 434, filters out segment data for each different image shape 40 and moves the filtered segment data into an on-line data structure in controller RAM 100 which is allocated for the image shape 40. In filtering the on-line segment data, the method employs several rules. First, if the on-line segment data being considered has the same y-position as previously considered on-line segment data, the former segment data belongs to a different image shape 40. Second, on-line segments of the same on-line shape must include an x-position that overlaps. Third, on-line segments of the same on-line shape must have adjacent y-positions.

After filtering on-line segment data for the on-line shapes at step 434, the on-line interrupt handling method computes, at step 436, the x/y position of each on-line shape and stores the x/y position in the appropriate on-line data structure in controller RAM 100 that is allocated for each on-line shape. The method advances to step 438 (discussed in more detail below) where a control shape identification number is assigned to each on-line shape by comparing the on-line shapes to the control shapes. Next, the x/y position of each on-line shape is compared, in step 440, to the x/y position of each target presented by the scenario. Each on-line shape is then scored as a "hit" or "miss" in step 442. The method, at step 444, returns to the controller foreground method at step 308.

Figure 15:
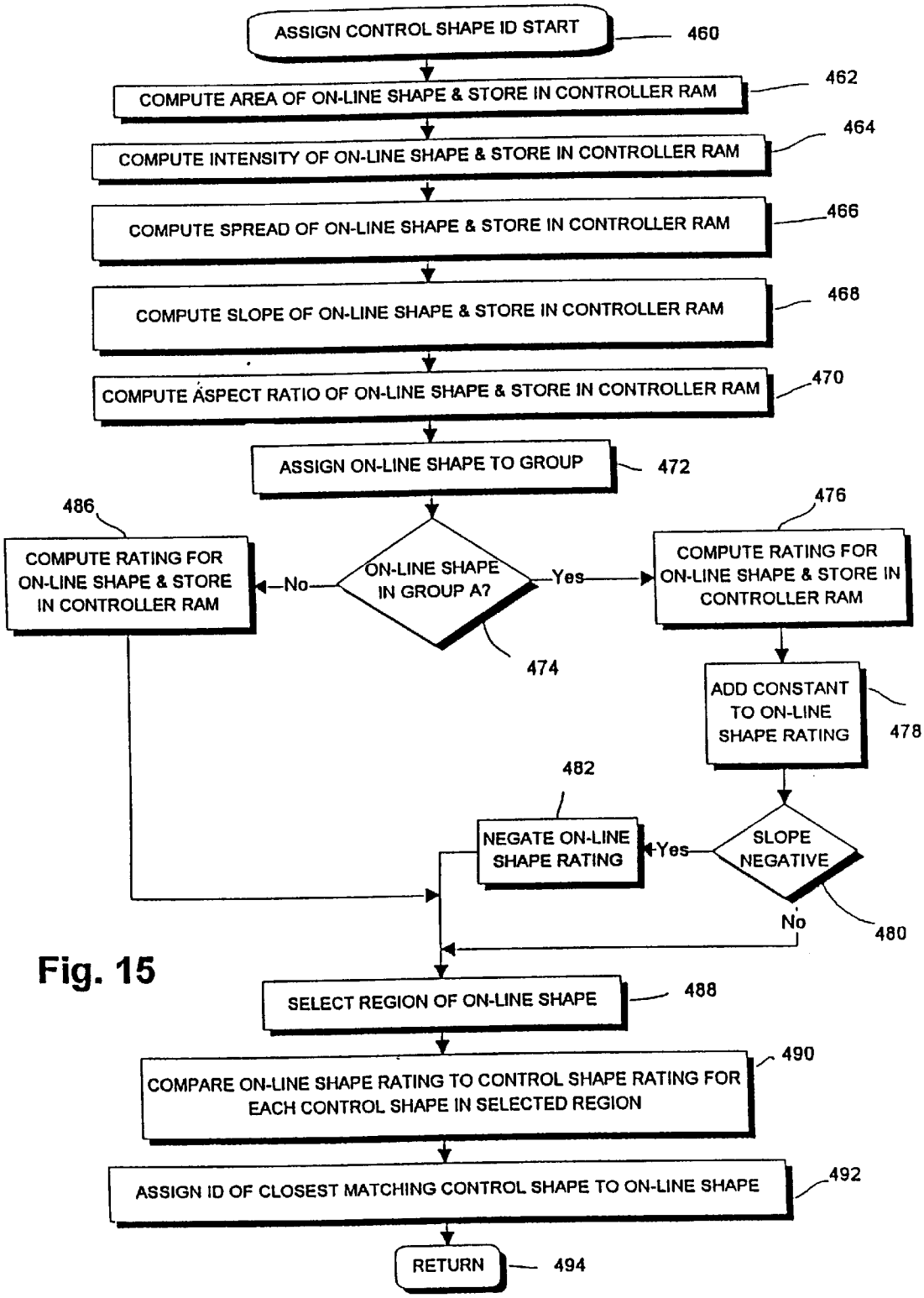
FIG. 15 is a flow chart representation of the method utilized by the on-line interrupt handling method of FIG. 14 to assign a control shape identification number to an on-line shape.

Step 438, assigning a control shape identification number to each on-line shape, is shown in flow chart form in more detail in FIG. 15. The assignment method starts at step 460 and advances through steps 462, 464, 466, 468, and 470 where the area, intensity, spread, slope, and aspect ratio are calculated respectively for an on-line shape in a manner substantially similar to that employed for a control shape as described above. The values computed for the area, intensity, spread, slope, and aspect ratio are stored in the appropriate on-line data structure in controller RAM 100. Advancing to step 472, the method assigns the on-line shape to a first group if its aspect ratio is greater than two (indicating an elliptical shape), otherwise the on-line shape is assigned to a second group (indicating a circular shape).

At decision step 474, the method checks to see if the on-line shape is in the first group (i.e. Group A). If yes, the method computes a rating from a weighted sum of the on-line shape's area, spread, and intensity at step 476 and stores the rating in the appropriate on-line data structure in controller RAM 100. A constant, unique for the first group, is added to the on-line shape rating at step 478. Upon checking the slope of the on-line shape at decision step 480, the method continues to step 484 if the slope is positive. If the slope is negative, the method, at step 482, negates the computed on-line shape rating before proceeding to step 484. If, on the other hand, the method, at step 474, determines that the on-line shape is not in the first group, the method computes a rating for the on-line shape from a weighted sum of the on-line shape's area, spread, and intensity and stores the rating in the appropriate on-line shape data structure at step 486.

Proceeding at step 488, the method selects the region 902 (see FIG. 11) in which the on-line shape lies by comparing the x-position of the on-line shape to the x-positions forming the boundaries for the regions 902. After selecting a region 902 in step 488, the method, at step 490, compares the on-line shape rating for the on-line shape against the control shape ratings computed, in step 854 (see FIG. 12), for each control shape in the selected region 902. Upon finding the control shape having the closest rating to that of the on-line shape, the method assigns the identification number of the control shape to the on-line shape in step 492. An identification number having been assigned, the method, at step 494, returns to the on-line data interrupt handler at step 440 (see FIG. 14).

Figure 16A:
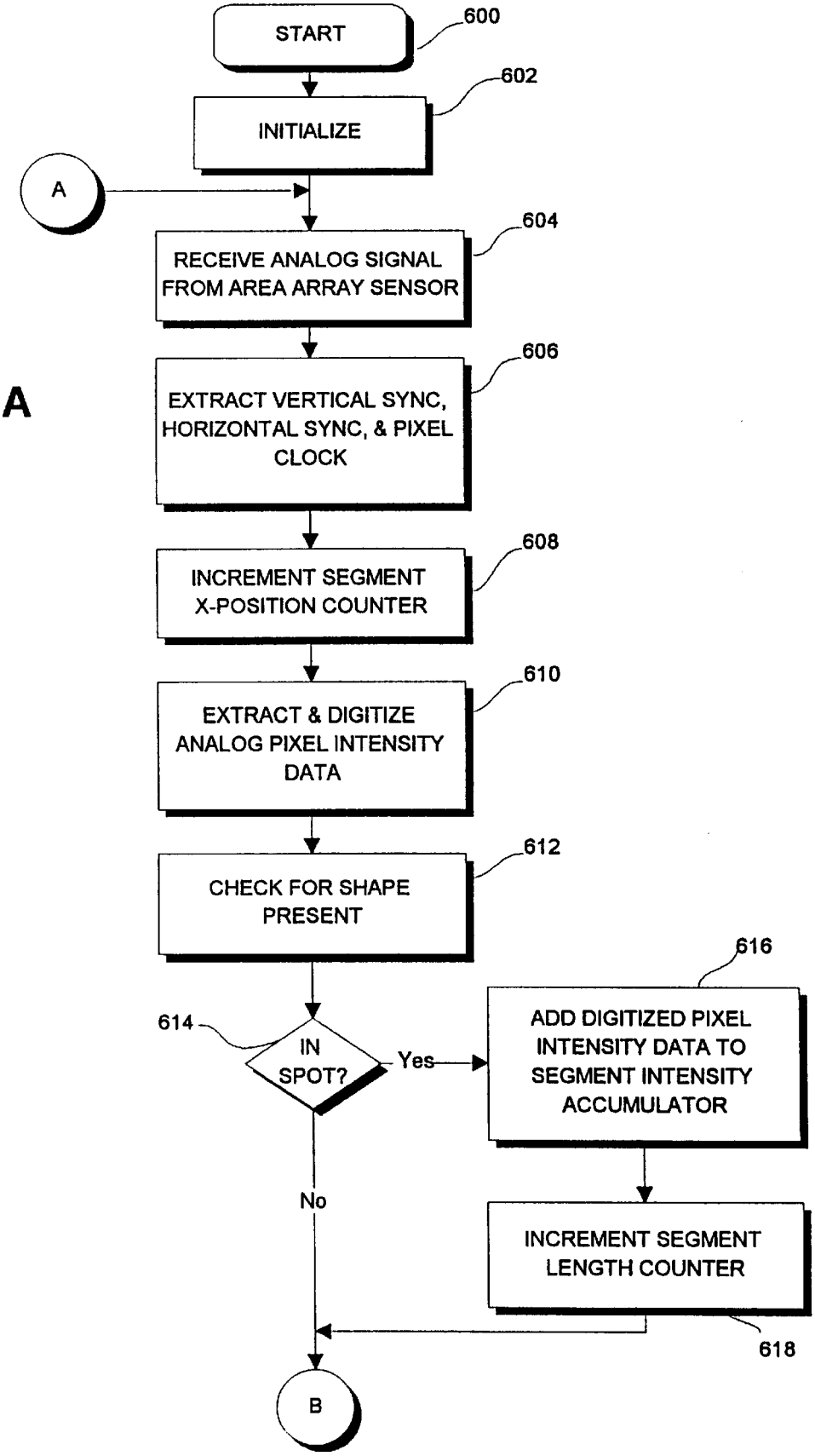

Referring now to FIGS. 16A and 16B, which show a flow chart representation of the steps taken by the data acquisition interface process employed by the data acquisition interface 500. Also, for convenience, referring to FIG. 6. After starting at step 600 when AC power is supplied to the controller, the process initializes the data acquisition interface 500, at step 602, by zeroing the segment intensity accumulator 540, the segment length counter 516, the segment x-position counter 550, and the segment y-position counter 552. For the segment intensity accumulator 540 and the segment length counter 516, this is accomplished by the state machine 524 placing a low signal pulse on clear line 532, thereby sending a low signal pulse to the clear inputs 547, 568 of the segment intensity accumulator 540 and segment length counter 516, respectively. For the segment x-position counter 550 this is accomplished by the sync separator/pixel clock generator 508 placing a low signal pulse on horizontal sync line 554, thereby sending a low signal pulse to the clear input 558 of the segment x-position counter. For the segment y-position counter 552, this is accomplished by the sync separator/pixel clock generator 508 placing a low signal pulse on the vertical sync line 556, thereby sending a low signal pulse to the clear input 564 of the segment y-position counter 552.

After the application of electrical power, at step 600, and initialization, at step 602, the data acquisition interface 500 continually receives an analog signal 700, output from the area array image sensor 42 through connector 502 at step 604. Referring to FIG. 17, the analog signal 700 comprises a plurality of horizontal sync pulses 702 and a plurality of vertical sync pulses 704. As discussed above, the horizontal sync pulses 702 represent the completion of output from each row of sensors in the area array image sensor, while the vertical sync pulses 704 represent the completion of output for a single pass through all rows of sensors in the area array image sensor (i.e., also referred to herein as one frame of sensor data). Also, as discussed above, the analog signal 700 further comprises a plurality of segment intensity data 706 which is positioned between horizontal sync pulses 702, whenever detected, and appears, as seen in inset "A" and FIG. 18, as a spike in the analog signal 700. Upon receiving the analog signal 700, the sync separator/pixel clock generator 508 extracts the horizontal and vertical sync pulses 702, 704 at step 606 and outputs the pulses 702, 704 on horizontal and vertical sync lines 554, 556, respectively. At step 606, the sync separator/pixel clock generator 508 also generates a pixel clock signal on pixel clock line 510 having one clock cycle for each column of sensor data rasterized by the area array image sensor 42. The pixel clock signal increments the segment x-position counter at step 608, thereby causing the segment x-position counter, at any time, to reflect the horizontal position of the sensor data currently being handled by the data acquisition interface 500.

At step 610 of the process, the segment intensity data 706 of the analog signal 700 is extracted and digitized by the A-to-D converter 506 producing digital intensity data on line 518. Then, the amplitude of the digital intensity data is compared, at step 612, against a pre-determined threshold amplitude value by the threshold detector 520 to detect the presence of a spot. The output signal of the threshold detector 520 on line 522 is set to indicate the presence or lack of presence of a spot. At decision step 614, the process determines whether the digital intensity data is within a spot. If no, the process proceeds to step 620. If yes, the process proceeds to step 616 where the digital intensity data on line 518 is added to the current segment intensity total held by segment intensity accumulator 540. To do so, the state machine 524 places a high signal pulse on clock enable line 530, thereby making the current segment intensity total available on intermediate total line 542. The adder 538 combines the digital intensity data on line 518 with the current segment intensity total on intermediate total line 542 and writes the resultant to the segment intensity accumulator 540. Proceeding to step 618, the process increments the segment length counter 618 using the pixel clock pulse on pixel clock line 510 as a clock when the high signal pulse is present on clock enable line 530. The clock enable line 530 then returns to its normally low state. Once the segment length counter 618 is incremented, the process proceeds to step 620.

At step 620, the process determines whether or not a previously detected spot has just been exited. To accomplish this step, the state machine 524 evaluates the signal from the threshold detector 520 and the state of the signal from the threshold detector 520 during the previous pixel clock cycle. If a spot has not just been exited, the process skips to step 630. If, on the other hand, a spot has just been exited, the process continues by proceeding to step 622, where the values of the segment x-position counter 550 and the segment length counter 516 are written to the FIFO buffer 576. Step 622 is implemented by the state machine 524 placing a select signal corresponding to input port 562 on mux select line 528, while placing a high signal pulse on write FIFO line 526. The process then writes the values of the segment y-position counter 552 and the segment intensity accumulator 540 to the FIFO buffer 576 at step 624 by the state machine 524 placing a select signal corresponding to input port 546 on mux select line 528. After the values are written to the FIFO buffer 576, the state machine 524 places a low signal pulse on write FIFO line 526. The process continues with the execution of step 626 and step 628 where the segment length counter 516 and the segment intensity accumulator 540 are reset to zero by the state machine 524 placing a low signal pulse on clear line 532.

The process, at step 630, determines whether or not the area array image sensor 42 has reached the end of a scan row by whether or not the sync separator/pixel clock generator 508 has extracted a horizontal sync pulse from the analog signal 700 and output a horizontal sync pulse on horizontal sync line 554. If no, the process continues with step 636. If yes, the segment x-position counter 550 is reset to zero at step 632 by the presence of the horizontal sync pulse on horizontal sync line 554. Then, the value of the segment y-position counter 552 is incremented, at step 634, by the clocking effect of the horizontal sync pulse on horizontal sync line 554. Once the segment y-position counter 552 has been incremented, the process moves to step 636.

At step 636, the process determines whether or not the area array image sensor 42 has reached the end of a frame by whether or not the sync separator/pixel clock generator 508 has extracted a vertical sync pulse from the analog signal 700 and output a vertical sync pulse on vertical sync line 556. If no, the process goes back to step 604 and continues repeatedly. If yes, the segment y-position counter 552 is reset to zero at step 638 by the presence of the vertical sync pulse on vertical sync line 556. Next, at step 640, because the vertical sync line 556 is connected to the interrupt line of the controller bus 96, the controller 32 is interrupted to read the FIFO buffer 576. To read the FIFO buffer 576 by making the FIFO data available on FIFO output lines 580 and, hence, on the controller bus 96, the controller 32 places a read signal on FIFO read enable line 578. After the FIFO data is read by the controller 32, the controller 32 removes the read signal from FIFO read enable line 578. The process then continues by looping back to step 604, where the analog signal 700 is received from the area array image sensor 500.

Whereas this invention has been described in detail with particular reference to its most preferred embodiments, it will be understood that variations and modifications can be effected within the spirit and scope of the invention, as described herein before and as defined in the appended claims.

We claim:

1. In a firearms training system that includes a reflective screen upon which preselected video scenarios are projected, a plurality of mock weapons that project respective spots of light upon the screen when their triggers are pulled by users as the scenarios are played out, a detector for detecting the spots of light on the screen and for detecting their position on the screen, and a control unit for analyzing the detected spots of light, a method of training multiple users simultaneously by discriminating one spot from another and thus determining which of the plurality of mock weapons generated each spot, said method comprising the steps of:

(a) causing each of the mock weapons to project a spot having a shape different from the spots projected by each of the other mock weapons on the screen;

(b) acquiring a set of identifying characteristics associated with the spots projected by the mock weapons;

(c) successively projecting the spot from each mock weapon onto the screen, detecting the projected spot, extracting the identifying characteristics from the projected spot, and storing the extracted identifying characteristics as a model representative of that spot;

(d) as the video scenario is played out on the screen, detecting the occurrence of spots projected on the screen when users fire their mock weapons at the screen;

(e) for each detected spot, extracting the preselected identifying characteristics from the spot, comparing the extracted characteristics to the stored models of the spots, and determining, based on the comparison, the model that is representative of the detected spot and thus determining which of the mock weapons generated the detected spot; and (f) scoring the users of the mock weapons based upon the results of step (e) to provide an indication of each user's performance in response to the scenario.

2. The method of claim 1 and wherein step (c) further comprises projecting the spot from each mock weapon onto the screen a plurality of times, detecting the projected spot each of the plurality of times, extracting the identifying characteristics from the projected spot each of the plurality of times, processing the extracted identifying characteristics for the plurality of times to combine the characteristics into a composite, and storing the composite as a model representative of the spot.

3. The method of claim 2 and further comprising the step of partitioning the screen into a plurality of regions and repeating step (c) for each of the regions of the screen to generate a model for each region, and wherein step (e) further comprises detecting the position of the spot on the screen, determining the region that contains the detected spot, and comparing the extracted characteristics for the detected spot to the models for the region that contains the spot.

4. The method of claim 1 and where in step (b), the identifying characteristics include the intensity of the spot.

5. The method of claim 1 and where in step (b), the identifying characteristics include the spread of the spot.

6. The method of claim 1 and where in step (b), the identifying characteristics include the aspect ratio of the spot.

7. The method of claim 1 and where in step (b), the identifying characteristics include the area of the spot.

8. The method of claim 1 and where in step (b), the identifying characteristics include the slope of the spot.

9. The method of claim 1 and where in step (b), the identifying characteristics include the spread, aspect ratio, area, and slope of the spot.

10. The method of claim 9 and where in step (b), the identifying characteristics further include the intensity of the spot.

11. The method of claim 1 and wherein step (a) comprises providing each of the mock weapons with a laser light source for projecting a spot onto the screen and intercepting the laser light with a lens within the mock weapon to produce a spot of predetermined shape on the screen.

12. The method of claim 11 and wherein the lenses are configured so that spots projected onto the screen are ellipses having predetermined shapes and orientations.

13. The method of claim 12 and wherein each of the spots is projected with an intensity that is different from each of the other projected spots.

14. The method of claim 12 and where in step (b), the identifying characteristics include the spread, aspect ratio, area, and slope of the elliptical spots.

15. A method of discriminating between spots of light projected on a reflective screen by mock weapons in a firearms training system, said method comprising the steps of:

(a) causing each of the mock weapons to project a spot of light having a shape different from the shapes of the spots projected by the other mock weapons;

(b) selecting a set of identifying characteristics associated with the shapes of the spots;

(c) detecting the occurrence of a spot projected on the screen as a result of a mock weapon being fired at the screen by a user;

(d) extracting the preselected identifying characteristics for the detected spot; and (e) analyzing the extracted characteristics to determine which of the mock weapons was fired to produce the spot.

16. The method of claim 15 and further comprising the step of creating models of each of the spots by successively causing each mock weapon to project its spot onto the screen a plurality of times, determining the identifying characteristics from the spot each time, combining the determined characteristics, and storing the combined characteristics as a model of the spot, and wherein step (e) comprises comparing the extracted characteristics to the stored models of the spots to determine closes matching model.

17. The method of claim 16 and wherein the spots projected by the mock weapons are substantially elliptical with each spot having a predetermined orientation on the screen.

18. The method of claim 17 and wherein the identifying characteristics include the spread of the spots.

19. The method of claim 17 and wherein the identifying characteristics include the aspect ratio of the spots.

20. The method of claim 17 and wherein the identifying characteristics include the area of the spots.

21. The method of claim 17 and wherein the identifying characteristics include the slope of the spots.

22. The method of claim 17 and wherein the identifying characteristics include the rating of the spots.

23. The method of claim 17 and further comprising the step of causing each of the mock weapons to project a spot having an intensity different from the intensities of the other spots and wherein the identifying characteristics include the intensity of the spots.

24. The method of claim 16 and wherein the step of causing each of the mock weapons to project a spot on the screen a plurality of times comprises partitioning the screen into regions, causing each mock weapon to project its spot within each region a plurality of times and wherein a model of the spot is stored for each region.

25. The method of claim 24 and wherein step (c) includes determining which region of the screen the detected spot is contained within and wherein step (e) comprises comparing the extracted characteristics to the models of the spots for that region.

26. The method of claim 15 and wherein step (d) comprises pixelizing the detected spot into rows and columns of pixels and analyzing the pixels to extract the identifying characteristics.

* * * * *